US007268749B2

(12) United States Patent
Marcotte et al.

(10) Patent No.: US 7,268,749 B2
(45) Date of Patent: Sep. 11, 2007

(54) SUPPRESSION OF VERTICAL CROSSTALK IN A PLASMA DISPLAY PANEL

(75) Inventors: Robert G. Marcotte, New Paltz, NY (US); Norifusa Isobe, New Paltz, NY (US); William S. Schindler, New Paltz, NY (US)

(73) Assignee: Matsushita Electronic Industrial, Co., LTD, Osaka (JP)

( * ) Notice: Subject to any disclaimer, the term of this patent is extended or adjusted under 35 U.S.C. 154(b) by 387 days.

(21) Appl. No.: 10/494,092

(22) PCT Filed: May 13, 2003

(86) PCT No.: PCT/US03/15033

§ 371 (c)(1),
(2), (4) Date: Apr. 30, 2004

(87) PCT Pub. No.: WO03/098584

PCT Pub. Date: Nov. 27, 2003

(65) Prior Publication Data

US 2004/0252080 A1 Dec. 16, 2004

(51) Int. Cl.
*G09G 3/28* (2006.01)
*G09G 3/10* (2006.01)

(52) U.S. Cl. ..... 345/60; 315/169.4

(58) Field of Classification Search ..... 345/60, 345/63–68; 315/169.4
See application file for complete search history.

(56) References Cited

U.S. PATENT DOCUMENTS 4,009,415 A 2/1977 Ngo ..... 315/169
5,724,054 A 3/1998 Shinoda ..... 345/60
5,745,086 A 4/1998 Weber ..... 345/63
6,118,214 A 9/2000 Marcotte ..... 313/582
6,140,984 A * 10/2000 Kanazawa et al. ..... 345/67
6,184,848 B1 2/2001 Weber ..... 345/60
6,295,040 B1 * 9/2001 Nhan et al. ..... 345/60
6,411,268 B1 * 6/2002 Nakamura et al. ..... 345/60

(Continued)

FOREIGN PATENT DOCUMENTS

KR 2001-0035882 5/2001
KR 2003079488 10/2003 ..... 3/20

(Continued)

OTHER PUBLICATIONS

"Symmetrically driven PDP, with minimised current loops to reduce EMI", by Vossen, van Beek, Holtslag, and Derksen, Asia Display/IDW '01, pp. 993-996.

"*KIPO: Notice of Preliminary Rejection*", dated Jul. 18, 2006; from corresponding Korean Application No. 10-2004-7006952.

Notice of Preliminary Rejection for Korean Application No. 10-2004-7006952 dated Feb. 6, 2007.

(Continued)

*Primary Examiner*—Amr A. Awad
*Assistant Examiner*—Steven E Holton
(74) *Attorney, Agent, or Firm*—Ohlandt, Greeley, Ruggiero & Perle, L.L.P.

(57) ABSTRACT

A method for controlling electrodes in a plasma display panel (815), includes applying a voltage Ve to a sustain electrode during a setting up of the sustain electrode (710) for an addressing operation, where Ve2<Ve. Another method includes a) applying Ve2 to the sustain electrode during the addressing, where the sustain electrode is associated with a scan electrode (714) in an electrode pair, and b) applying a voltage Vs1 to the scan electrode during a discharging of the electrode pair after the addressing, where Ve2<Vs1.

27 Claims, 19 Drawing Sheets

U.S. PATENT DOCUMENTS 6,693,389 B2 * 2/2004 Marcotte et al. ..... 315/169.4
6,906,690 B2 * 6/2005 Lim ..... 345/60
2002/0003515 A1 * 1/2002 Lee et al. ..... 345/60
2003/0189534 A1 10/2003 Myoung et al. ..... 345/67

* cited by examiner

SUPPRESSION OF VERTICAL CROSSTALK IN A PLASMA DISPLAY PANEL

BACKGROUND OF THE INVENTION

1. Field of the Invention

The present invention relates to plasma display panels (PDPs), and more particularly, to an electronic waveform technique that minimizes vertical crosstalk in a PDP.

2. Background of the Art

Color PDPs are well known. FIG. 1 illustrates a prior art embodiment of a color alternating current (AC) PDP, as disclosed in U.S. Pat. No. 6,118,214 to Marcotte (hereinafter "the Marcotte '214 patent"), which is incorporated herein by reference. Transparent electrodes 11 are employed on a front panel. A front plate (not shown) includes horizontal plural pairs of sustain electrodes 10 that connect transparent electrodes 11 to a sustain bus 12. A plurality of pairs of scan electrodes 14 are juxtaposed to paired sustain electrodes 10, and both electrode sets are covered by a dielectric layer (not shown) and a magnesium oxide (MgO) layer (not shown). A back plate (not shown) supports vertical barrier ribs 16 and plural vertical column electrodes 18 (shown in phantom). Individual column electrodes 18 are covered with red, green, or blue (RGB) phosphors, as the case may be, to enable a full color display to be achieved. The front and rear plates are sealed together and a space therebetween is filled with a dischargeable gas.

An electrode pair is defined as (a) a sustain electrode 10 (and its adjacent transparent electrode 11) juxtaposed with (b) a scan electrode 14 (and its adjacent transparent electrode 11). A pixel 20 is defined as an area that includes intersections of (i) an electrode pair of sustain electrode 10 and scan electrode 14 on the front panel, and (ii) three column electrodes 18 for red, green, and blue, respectively, on the back panel. A subpixel corresponds to an intersection of a red, green or blue column electrode with an electrode pair of a sustain electrode and a scan electrode. For example, subpixel 19 corresponds to an intersection of a red column electrode 18 with an electrode pair of sustain electrode 10 and scan electrode 14.

Operating voltage and power of the PDP are controlled by a discharge gap 13 and a width of transparent electrode 11. The operating voltage of the PDP is controlled by the distance across the discharge gap 13, as the distance controls the breakdown voltage for a given gas mixture. Furthermore, sufficient voltage must be applied so that the ensuing gas discharge plasma is able to fully engulf the scan and sustain electrode pair. The power consumed by the discharge is affected by the surface capacitance of the electrode pair, which is proportional to electrode area and inversely proportional to the dielectric thickness.

A width of sustain electrode 10 and a width of scan electrode 14 are chosen to produce a narrow discharge gap 13 and a wide inter-pixel gap 15. When sufficient voltage is applied across discharge gap 13, the gas will break down forming a discharge plasma. For a given applied voltage, the positively charged electrode is the anode and the negatively charged electrode is the cathode. The discharge plasma has two distinct regions, the positive column and the negative glow. The positive column consists predominantly of fast moving electrons seeking the positive charge on the surface of the anode electrode. Conversely, the negative glow contains slow moving ions drifting toward and across the negatively charged cathode electrode. The duration of the discharge is limited by the amount of charge on the dielectric surfaces. Once the charge has been transferred, the discharge self-extinguishes, with the cell voltage equaling zero, and the dielectric covering the electrodes is oppositely charged. Within a sustain time period, this process is repeated by alternating the voltage polarity after each discharge completes. Inter-pixel gap 15 must be made sufficiently large to prevent the energetic positive column of the plasma discharge from bridging the inter-pixel gap and corrupting an ON or OFF state of an adjacent pixel. The width of the transparent electrode 11 and the thickness of a dielectric glass (not shown) over the electrode determine the pixel's discharge capacitance, which controls the discharge power and therefore brightness. For a given discharge power/brightness, a number of discharges is chosen within sustain time periods to provide gray scales which sum to meet the overall brightness requirement for the panel.

FIG. 2 shows a typical prior art block diagram of a PDP system 200. An analog video signal is input into logic 230 where the signal is digitized, processed, and temporarily stored. Once a frame's worth of data is stored, logic 230 begins a process of displaying data through a series of subfields, typically 8 to 12, as disclosed in U.S. Pat. No. 5,724,054 to Shinoda.

FIG. 3 is a graph showing a division of a frame time into 8 subfields (i.e., SF1-SF8). During each addressing period lines Y1 through Y480 are scanned sequentially by row drivers 210, while video input is applied through column drivers 225 to set each sub-pixel in the ON state as required by the video input. Each subsequent sustain period is weighted with sustain pulses to achieve weighted light intensities for each subfield.

FIG. 4 shows a typical division of a subfield. Each subfield has a setup period, an addressing period, and a sustain period. The setup period turns off any ON pixels, primes the MgO layer, and sets up all the pixels for addressing. Referring to both FIG. 2 and FIG. 4, during the addressing period, a scan generator 205, in conjunction with row drivers 210, sequentially drives each row low for addressing. Once a given row is enabled, logic 230 loads column drivers 225 with image data corresponding to individual RGB sub-pixels requiring illumination based upon received image data. Column drivers 225 apply voltage Vx to selected column electrodes. The coincidence of a selected row and an applied column voltage initiates a weak discharge that cascades into a discharge between the selected scan electrode and its neighboring sustain electrode. Once completed, the discharge has placed the addressed sub-pixel in the ON state. Any column not driven will remain in the OFF state. While the addressing discharge does produce visible light, it is not of sufficient brightness to represent the image properly. Consequently, a sustain period follows the addressing period after the last row has been addressed. During the sustain period, scan generator 205 and a sustain generator 220 supply alternating sustain pulses so that a momentary ac-plasma discharge occurs on an application of each pulse. Each sustain discharge produces ultra violet light that excites surrounding phosphor which in-turn produces visible light. Each subfield within a frame contains a sufficient number of sustain pulses and in-turn discharges to achieve a desired brightness for each subfield. Since each sub-pixel can be addressed independently in each subfield, a large color palate is obtainable.

FIG. 5*a* shows a prior art composite waveform between the scan and sustain electrodes. Due to a capacitive relationship of the scan and sustain electrodes, the composite waveform is simply an output of scan generator 205 (FIG.

4 Scan waveform), minus an output of sustain generator 220 (FIG. 4 Sustain waveform). Note that applied data pulses are not included in FIG. 5*a*.

FIGS. 5*b*-5*e* show cell voltage waveforms for each pixel addressing sequence. A cell voltage is an AC coupled voltage present on a gas side of a dielectric layer between a scan and sustain electrode pair. The cell voltage is limited, positive and negative, by a breakdown voltage of the gas, Vbr and −Vr.

When the breakdown voltage is exceeded in either direction, two types of discharges can occur, a well-known negative resistance discharge and a more recently discovered positive resistance discharge. According to U.S. Pat. No. 5,745,086 to Weber, and referring to FIG. 4, if an applied waveform rises or falls slowly, as in rising and falling ramps of the setup period t12 and t15, the gas will discharge having a positive resistance characteristic, behaving much like a zener diode limiting the voltage across the gas to the breakdown voltage Vbr. If the applied voltage exceeds the breakdown voltage sharply, as in the sustain periods t23, t24, a negative resistance or avalanche discharge occurs, which reduces the cell voltage to zero. Once the cell voltage reaches zero, the discharge self extinguishes.

The addressing discharge is also a negative resistance discharge, exhibiting the characteristics of a positive column discharge as disclosed in U.S. Pat. No. 6,184,848 to Weber (hereinafter "the Weber '848 patent"). The Weber '848 patent defines the positive column discharge as having a trigger cell and a state cell. A panel topology is similar to that of FIG. 1, but less transparent electrodes 11 thereby creating a large discharge gap. In the presence of a high cell voltage, due to an application of sustain pulses following an addressing operation, a weak discharge forms between a positively charged back plate electrode and a negatively charged front electrode. This intersection is said to be a trigger cell. The weak discharge, in conjunction with the high cell voltage, yields a discharge where the plasma forms two clearly distinct regions, a negative glow and a positive column. The negative glow consists of slow moving positively charged ions, and the positive column consists of slow moving ions and rapidly moving electrons. The electrons move toward the positively charged anode, and the ions drift slowly toward the negatively charged cathode. As the weak discharge strengthens, the negative glow expands about the trigger cell, and the positive column spreads along the back plate's phosphor layer to the positively charged state cell. The discharge completes when the wall charge is reversed between the trigger cell and the state cell.

For the addressing discharge in the PDP of FIG. 1, the intersection of the column electrode and the selected scan electrode forms the trigger cell, and the corresponding sustain electrode intersecting with the same column electrode forms the state cell. At the completion of the setup period t16, each pixel is setup so that cell voltage is at the discharge level −Vr. When the pixel is addressed, a weal, discharge forms at the intersection of the selected scan electrode and at each of the driven back plate column electrodes. The discharge develops producing a positive column which spreads along the positively charged back plate electrode to the positively charged sustain electrode. As the electrons in the plasma move toward the anode, the anode looses its positive charge and becomes negatively charged. Likewise, the negatively charged cathode attracts positively charged ions and becomes positively charged. Hence, as the cell voltage is reduced to zero, the wall charge on the sustain electrode dielectric layer is reversed.

FIG. 5*b* shows cell voltages for a previously OFF pixel, which is setup for addressing, not addressed, and remains OFF in a latter sustain period. Specifically, a rising ramp t12 in a setup period rises, bringing the cell voltage above the breakdown voltage and clamps the cell voltage at Vbr. Voltage Ve being applied at t13, as shown in FIG. 4, ensures that an address discharge will be strong enough for a first sustain discharge to occur properly. A transition into the falling ramp t13 and t14 reverses the cell voltage and the falling ramp t15 clamps the cell voltage at −Vr. At the conclusion of the setup period, the cell voltage is at −Vr. A row select pulse at time t17 in FIG. 4 exceeds the breakdown voltage slightly due to a difference between Vrf and 0V. Since the falling ramp during time t15 stops at Vrf above 0V, a small negative voltage is effectively applied when the row select pulse is applied at time t17 to exceed the breakdown voltage −Vr. Since this effective negative voltage, caused by Vrf is small and the width of the row select pulse at t17 is narrow, no discharge activity occurs unless there is a video input dictated data pulse on a data electrode coincident with the row select pulse at time t17 as shown in FIG. 4. In FIG. 5*b*, no data pulse is applied, and so there is no discharge activity at time t17. Since an address discharge did not occur, the cell voltage produced by the first sustain pulse at t21 is not greater the positive breakdown voltage Vbr and no sustain discharge will occur.

FIG. 5*c* shows the turn-on process for an OFF pixel. The setup period occurs as in FIG. 5*b* and a data pulse (not shown) is applied to the columns at time t17 triggering an address discharge which returns the cell voltage to zero. Later at time t21, after the remaining rows have been addressed, the first sustain discharge will occur on any pixel which was addressed. For the first sustain pulse, the scan electrode is driven high before lowering the sustain electrodes, unlike subsequent sustain pulses. This method of generating the first discharge prevents a premature discharge, which can form if the sustain electrode voltage of Ve, 220V is lowered before raising the scan electrode voltage to sustain voltage Vs, 180V, due to the application of voltage Ve in the setup period as shown in FIG. 4 during addressing. Having been addressed previously, the breakdown voltage Vbr is exceeded, and a negative resistance discharge will occur, again returning the cell voltage to zero. Each subsequent sustain pulse initiates another discharge producing the light of an ON pixel.

Following the first sustain discharge, the falling edge of the scan electrodes lowers the cell voltage towards the negative breakdown voltage −Vr. The subsequent rise of the other sustain electrodes adds more voltage across the gas and exceeds the breakdown voltage −Vr, producing the next discharge. This process continues for the duration of the sustain period with the discharges alternating back and forth.

FIG. 5*d* shows a re-addressing of an ON pixel. The application of the setup pulse at time t11 causes the last negative resistance discharge of the previous subfield's sustain period. Since the cell voltage was returned to zero by the discharge, the rising ramp at t12 will not discharge since the rising cell voltage does not exceed Vbr. The falling ramp limits the cell voltage to −Vr, as it did in FIGS. 5*b* and 5*c*. At time t17, a data pulse is applied with the row select, a discharge occurs, and the pixel is returned to the ON state.

FIG. 5*e* shows an ON pixel which is erased by the falling ramp t15 as in FIG. 5*d*, however it is not re-addressed, and is OFF in the latter sustain period.

As disclosed in the Marcotte '214 patent, the paired front plate electrode configuration of FIG. 1 has the advantage of reduced inter-electrode capacitance, which reduces the power dissipation resulting from charging and discharging of the inter-electrode capacitance with each sustain pulse. However, there is an increased probability of vertical crosstalk. Vertical crosstalk occurs when a discharge at one discharge site spreads into a vertically adjacent discharge site. The Marcotte '214 patent utilizes a large inter-pixel gap to help increase vertical pixel-to-pixel isolation. Note that the back plate barrier ribs provide horizontal pixel isolation but no vertical isolation. The greatest probability of crosstalk occurs during the addressing discharge where the plasma discharge forms between a selected scan and data electrodes and the positive column spreads to the sustain electrode.

FIG. 6 shows the time sequenced discharge mechanics for an address discharge showing crosstalk discharge. The pictorial is a cross sectional view the PDP of FIG. 1 showing front plate electrodes on top and orthogonally oriented address electrode on the bottom, which is covered by a phosphor layer. P1 refers to the red sub-pixel 19 of FIG. 1 and a vertically adjacent red sub-pixel, P2 with inter-pixel gap 15 separating P1 and P2. The time t0 for each row occurs with the application of the row select pulse at time t17 in conjunction with an applied data pulse to the address electrode. The sub-pixels were setup by the falling ramp applied to the scan electrodes while Ve was applied to the sustain electrodes. This places the negative charge on the scan electrodes and the positive charge on the sustain and back plate electrodes prior to t0. Vrf allows the row select pulse to slightly exceed the breakdown voltage to help speed up the address discharge. The application of voltage Vscan at time t16, in FIG. 4, by the row drivers 210, acts as a row deselect voltage by reducing the negative voltage on the non-selected rows so that the cell voltage on the scan electrodes is reduced. This prevents the addressing of one row from affecting the other rows in the display. The full cell voltage returns at time t17 when the row is selected, and the breakdown voltage −Vbr is exceeded as shown in FIG. 5*b*. The Vscan voltage is a de-select voltage and must be high enough to ensure sufficient row to row isolation in the presence of applied column voltages.

If a data pulse is provided, at time t0 in FIG. 6 a weak discharge forms between the back plate address electrode and the active scan electrode, and at time t1, a negative resistance plasma discharge forms. At time t2, the availability of positive charge on the sustain electrodes allows the positive column to rapidly engulf the sustain electrode, and at time t3 can easily spread across the inter-pixel gap to the neighboring sustain electrode and thereby deplete the positive charge of the neighboring pixel P2. When P2's scan electrode is selected and the column electrode is driven, the weak back to front discharge may form, however, without the positive charge on the sustain electrode, the plasma will not form, the scan electrode will maintain its negative charge, and pixel P2 will remain off.

In a paper entitled "Symmetrically driven PDP, with minimized current loops to reduce EMI" by Vossen et al. (hereinafter "the Vossen et al. paper"), there is disclosed the usage of interlaced addressing to reduce crosstalk in a PDP. With interlaced addressing, the odd rows are addressed followed by the even rows. As such, any gas priming resulting from addressing the odd rows will be fully extinguished prior to addressing the even rows. The Vossen et al. paper also talks of a symmetrically sustained PDP that uses the paired electrode configuration described in the Marcotte '214 patent as helping to reduce vertical crosstalk. However, the Vossen et al. paper does not describe or correct for the form of vertical crosstalk described herein. Specifically, the Vossen et al. paper describes addressing with the electrodes configured as non-paired electrodes (i.e., scan, sustain, scan, sustain), which does not have a common potential across an inter-pixel gap during addressing. In the non-paired case, a crosstalk discharge will in fact go in the wrong direction, discharging to an incorrect sustain electrode. The use of interlaced addressing reduces this likelihood of this artifact.

SUMMARY OF THE INVENTION

There is provided a method for controlling electrodes in a plasma display panel (PDP). One aspect of the method includes applying a voltage Ve to a sustain electrode during a setting up of the sustain electrode for an addressing operation involving the sustain electrode, and applying a voltage Ve2 to the sustain electrode during the addressing operation, where Ve2<Ve. This application of voltages weakens an address discharge of a sub-pixel.

Another aspect of the method includes (a) applying a voltage Ve2 to a sustain electrode during an addressing operation involving the sustain electrode, where the sustain electrode is associated with a scan electrode in an electrode pair, and (b) applying a voltage Vs1 to the scan electrode during a discharging of the electrode pair after the addressing operation, where Ve2<Vs1.

Yet another aspect of the method includes (a) applying a voltage Vs1 to a first scan electrode during a discharging of an electrode pair after an addressing operation involving a sustain electrode, where the first scan electrode is associated s with the sustain electrode in the electrode pair, and (b) applying a voltage Vs2 to a second scan electrode during the discharging, where the second scan electrode is adjacent to the first scan electrode, and where Vs2<Vs1.

There is also provided an apparatus for controlling electrodes in a plasma display panel. One aspect of the apparatus includes a circuit that applies a voltage Ve to a sustain electrode during a setting up of the sustain electrode for an addressing operation involving the sustain electrode, and a circuit that applies a voltage Ve2 to the sustain electrode during the addressing operation, where Ve2<Ve.

Another aspect of the apparatus includes (a) a circuit that applies a voltage Ve2 to a sustain electrode during an addressing operation involving the sustain electrode, where the sustain electrode is associated with a scan electrode in an electrode pair, and (b) a circuit that applies a voltage Vs1 to the scan electrode during a discharging of the electrode pair after the addressing operation, where Ve2<Vs1.

Yet another aspect of the apparatus includes (a) a circuit that applies a voltage Vs1 to a first scan electrode during a discharging of an electrode pair after an addressing operation involving a sustain electrode, where the first scan electrode is associated with the sustain electrode in the electrode pair, and (b) a circuit that applies a voltage Vs2 to a second scan electrode during the discharging, where the second scan electrode is adjacent to the first scan electrode, and where Vs2<Vs1.

DESCRIPTION OF THE INVENTION

Figure 7:
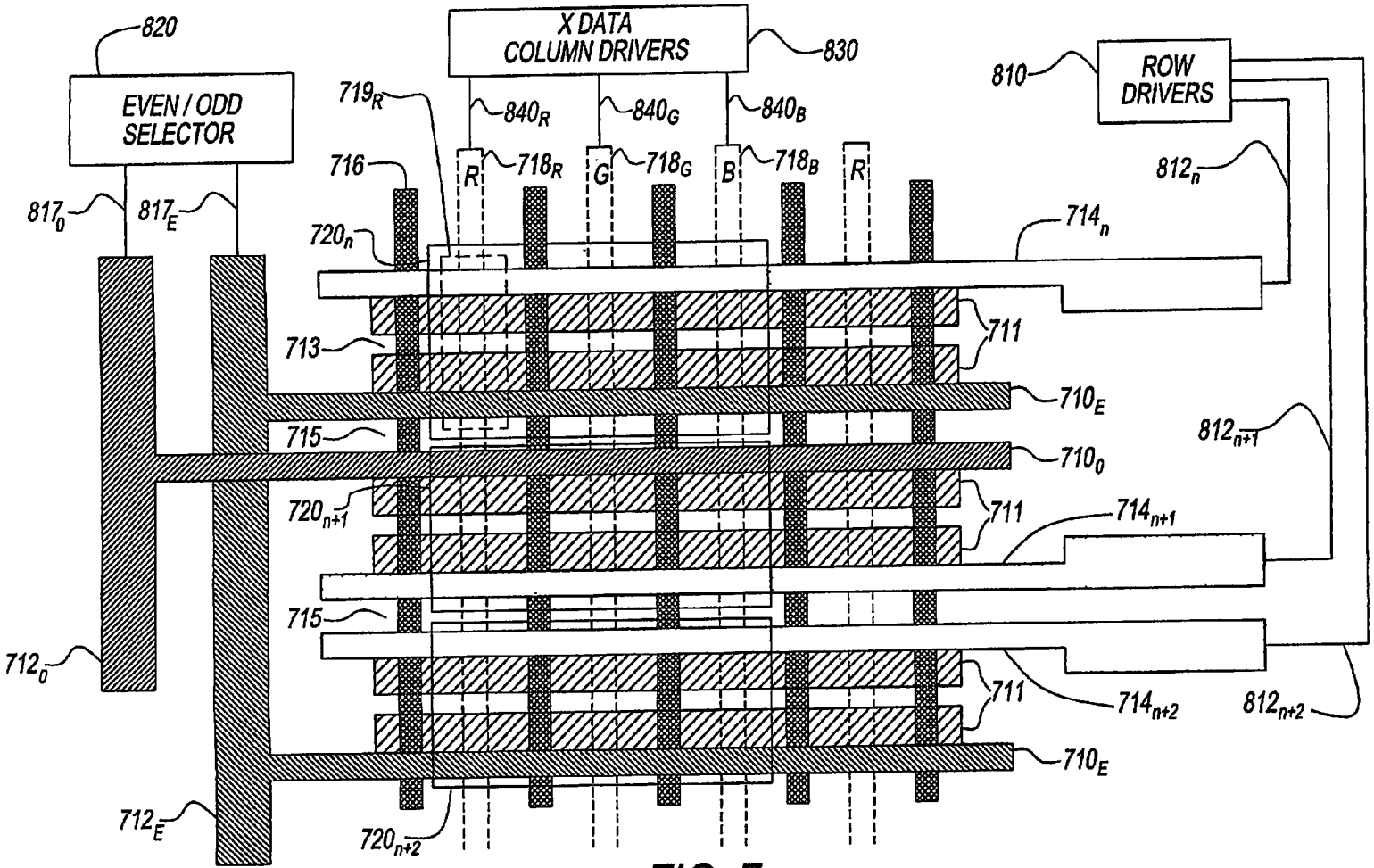
FIG. 7 is a schematic representation of a color PDP.

FIG. 7 is a schematic representation of a portion of a color PDP employing address crosstalk suppression. The PDP is organized into rows of pixels, three of which are shown, namely, a pixel $\mathbf{720}_n$ in row "n", a pixel $\mathbf{720}_{n+1}$ in row "n+1", and a pixel $\mathbf{720}_{n+2}$ in row "n+2". The rows are regarded as "odd" and "even" in an alternating pattern, where for example, row "n" is designated as an even row and row "n+1" is designated as an odd row.

The portion of the PDP shown in FIG. 7 includes an even sustain bus $\mathbf{712}_E$ connected to a bank of even sustain electrodes $\mathbf{710}_E$, an odd sustain bus $\mathbf{712}_O$ connected to a bank of odd scan electrodes $\mathbf{710}_O$, scan electrodes $\mathbf{714}_n$, $\mathbf{714}_{n+1}$ and $\mathbf{714}_{n+2}$, and column electrodes $\mathbf{718}_R$, $\mathbf{718}_G$ and $\mathbf{718}_B$ (for red, green, and blue, respectively). Each even sustain electrode $\mathbf{710}_E$ is adjacent to an odd sustain electrode $\mathbf{710}_O$. For example, even sustain electrode $\mathbf{710}_E$ in row "n" is adjacent to odd sustain electrode $\mathbf{710}_O$ in row "n+1". There is also a transparent electrode 711 associated with each of sustain electrodes $\mathbf{710}_E$ and $\mathbf{710}_O$, and scan electrodes $\mathbf{714}_n$, $\mathbf{714}_{n+1}$ and $\mathbf{714}_{n+2}$.

An intersection of a sustain electrode, a scan electrode and a column electrode, defines a subpixel. For example, a subpixel $\mathbf{719}_R$ is defined for the intersection of sustain electrode $\mathbf{710}_E$, scan electrode $\mathbf{714}_n$, and column electrode $\mathbf{718}_R$. Barrier ribs 716 separate subpixels from one another. Each pixel is defined as a region of intersection of a sustain electrode, a scan electrode, and three column electrodes. For example, pixel $\mathbf{720}_n$ is defined at the region of intersection of sustain electrode $\mathbf{710}_E$, scan electrode $\mathbf{714}_n$, and column electrodes $\mathbf{718}_R$, $\mathbf{718}_G$and $\mathbf{718}_B$. An inter-pixel gap 715 is defined for a region between adjacent pixels.

Each pixel includes a discharge gap where a sustain discharge forms. For example, in pixel $\mathbf{720}_n$, a discharge gap 713 is located between (a) a transparent electrode 711 associated with scan electrode $\mathbf{714}_n$ and (b) a transparent electrode 711 associated with even sustain electrode $\mathbf{710}_E$.

An even/odd selector 820 drives odd sustain bus $\mathbf{712}_O$ via an odd sustain driver line $\mathbf{817}_O$, and drives even sustain bus $\mathbf{712}_E$ via an even sustain driver line $\mathbf{817}_E$. Column driver 830 drives column electrodes $\mathbf{718}_R$, $\mathbf{718}_G$ and $\mathbf{718}_B$ via column driver lines $\mathbf{840}_R$, $\mathbf{840}_G$ and $\mathbf{840}_B$, respectively. Row drivers 810 drive scan electrodes $\mathbf{714}_n$, $\mathbf{714}_{n+1}$, and $\mathbf{714}_{n+2}$ via row driver lines $\mathbf{812}_n$, $\mathbf{812}_{n+1}$, and $\mathbf{812}_{n+2}$. The operation of even/odd selector 820, column driver 830 and row drivers 810 are further described in association with FIG. 8.

As mentioned earlier, FIG. 7 shows only a portion of the PDP. In practice, the PDP will include a plurality of rows and columns. Accordingly, column drivers 830 will drive many more columns than are shown in FIG. 7, and row drivers 810 will drive many more rows than are shown in FIG. 7.

Figure 8:
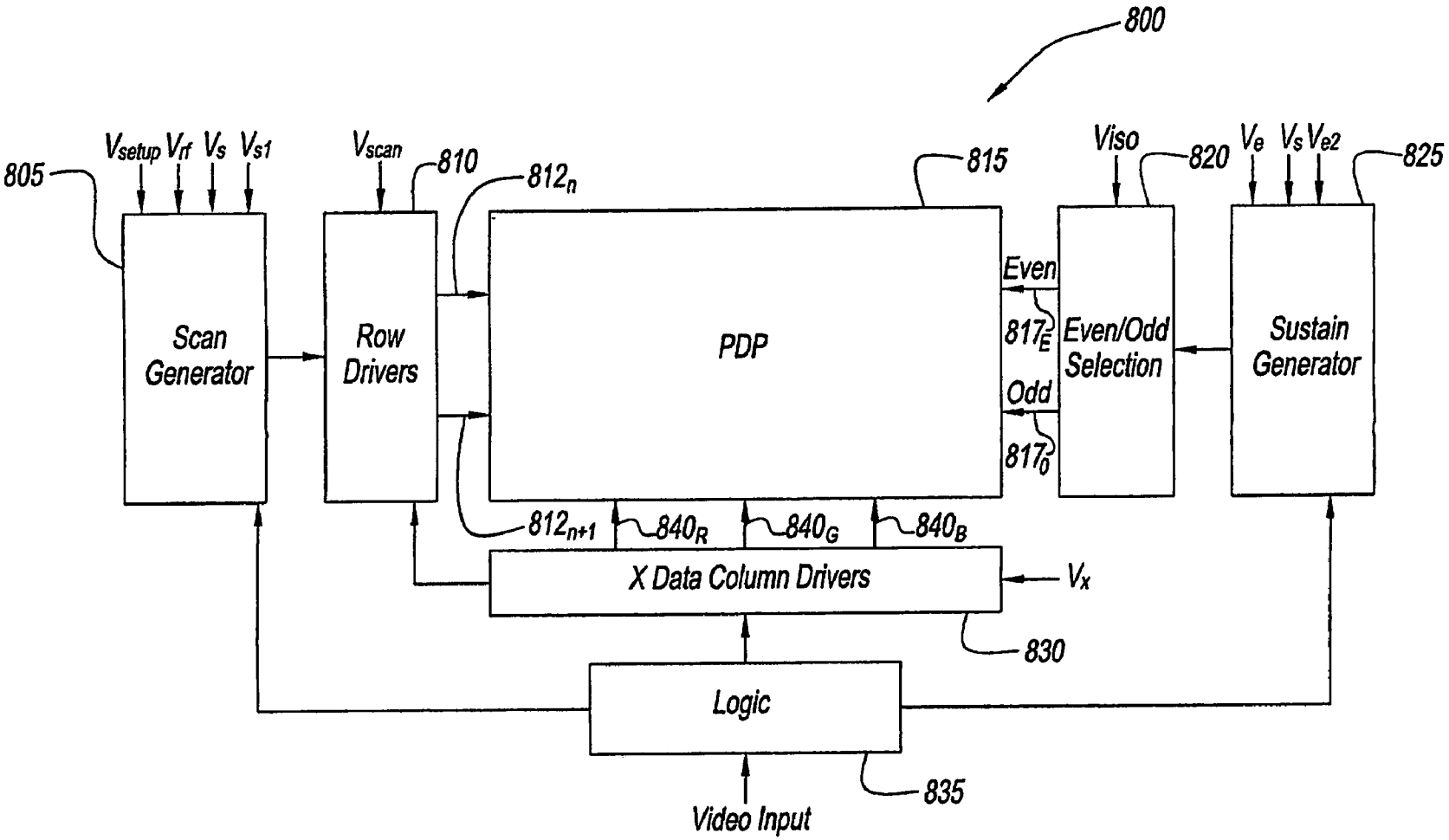
FIG. 8 is a block diagram of a PDP system providing vertical crosstalk suppression.

FIG. 8 is a block diagram of a PDP system 800 employing vertical crosstalk suppression during an addressing period. The principal components of system 800 include a scan generator 805, row drivers 810, a PDP 815, even/odd selector 820, a sustain generator 825, column drivers 830 and logic 835.

Figure 1:
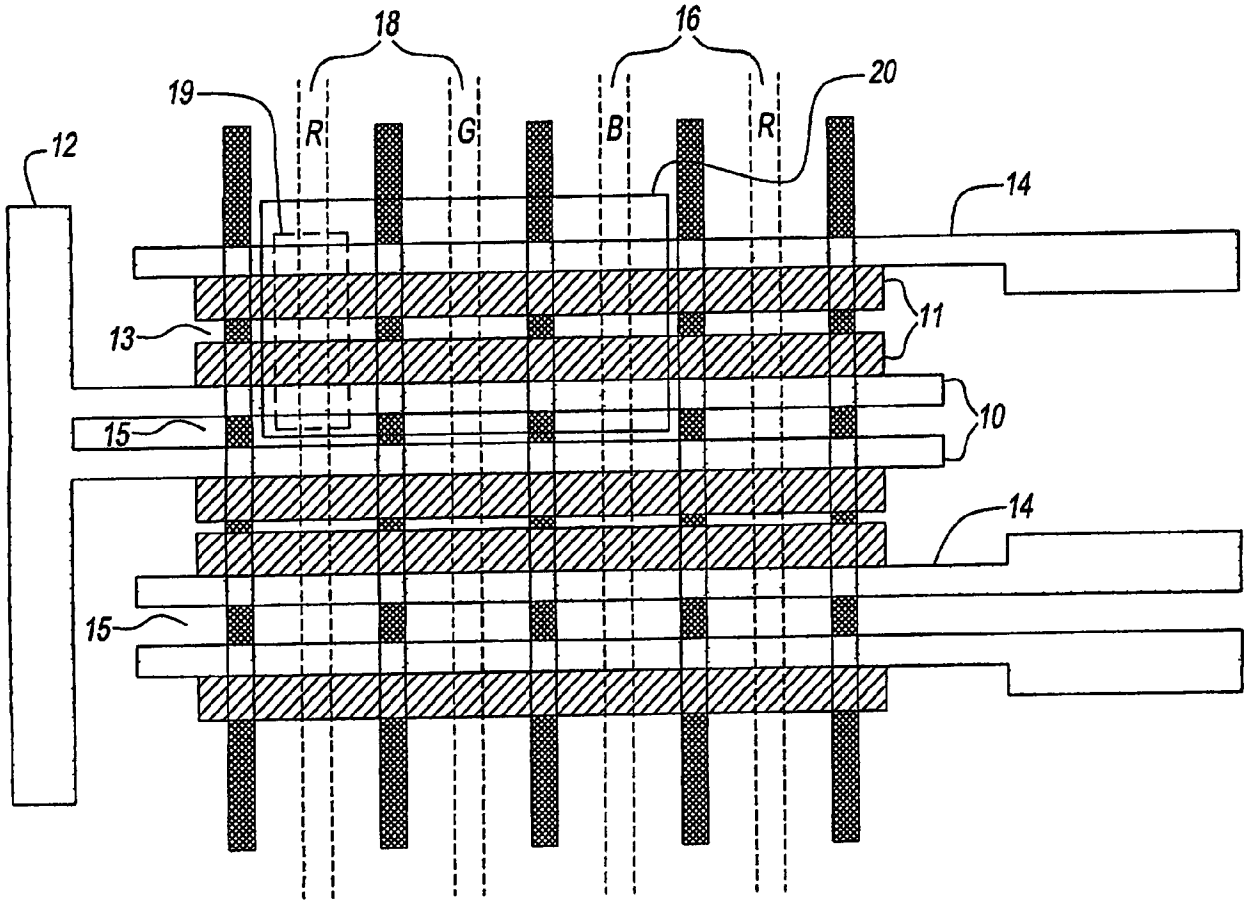
FIG. 1 (Prior Art)
FIG. 1 is a schematic representation of a conventional color PDP.
Figure 2:
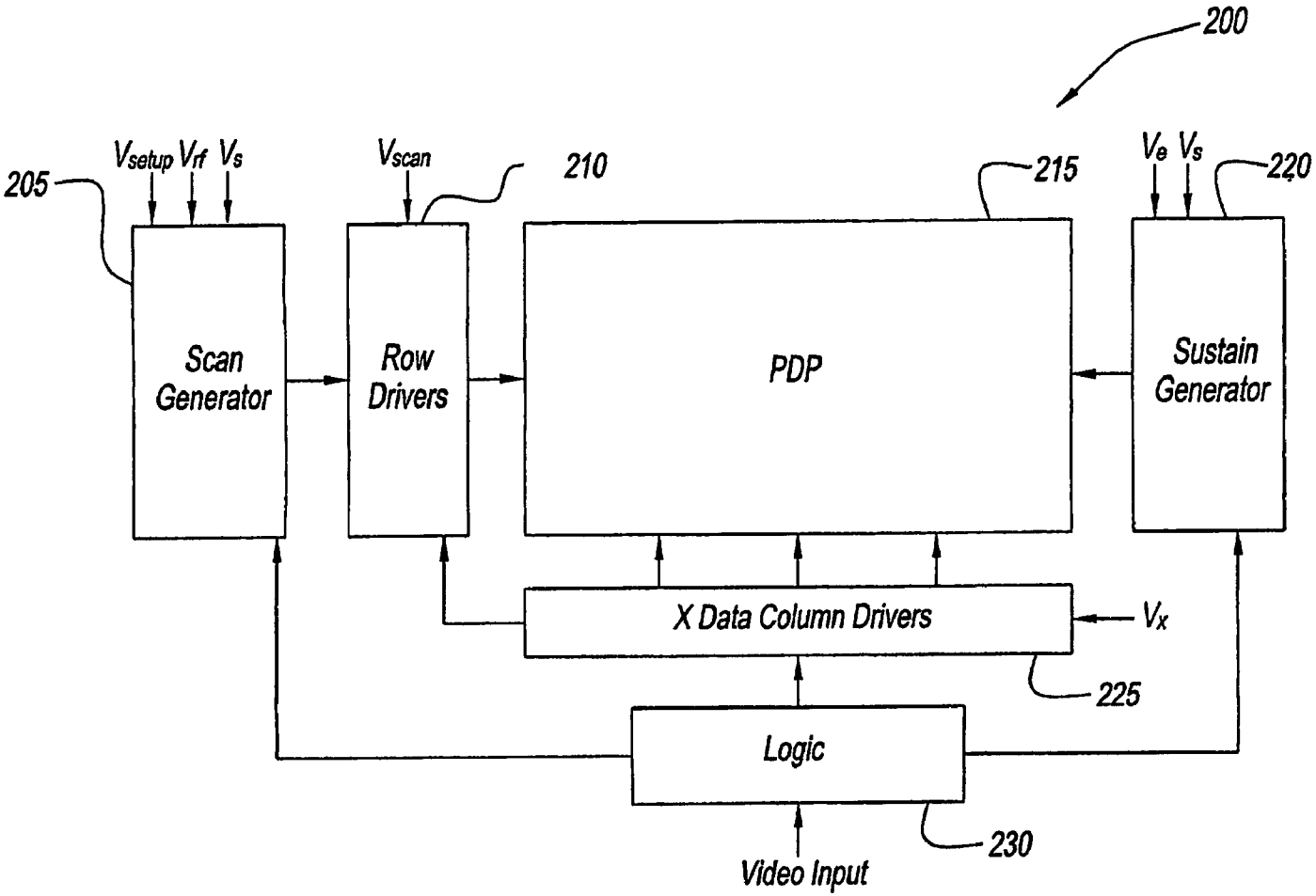
FIG. 2 (Prior Art)
FIG. 2 is a block diagram of a conventional PDP system.
Figure 3:
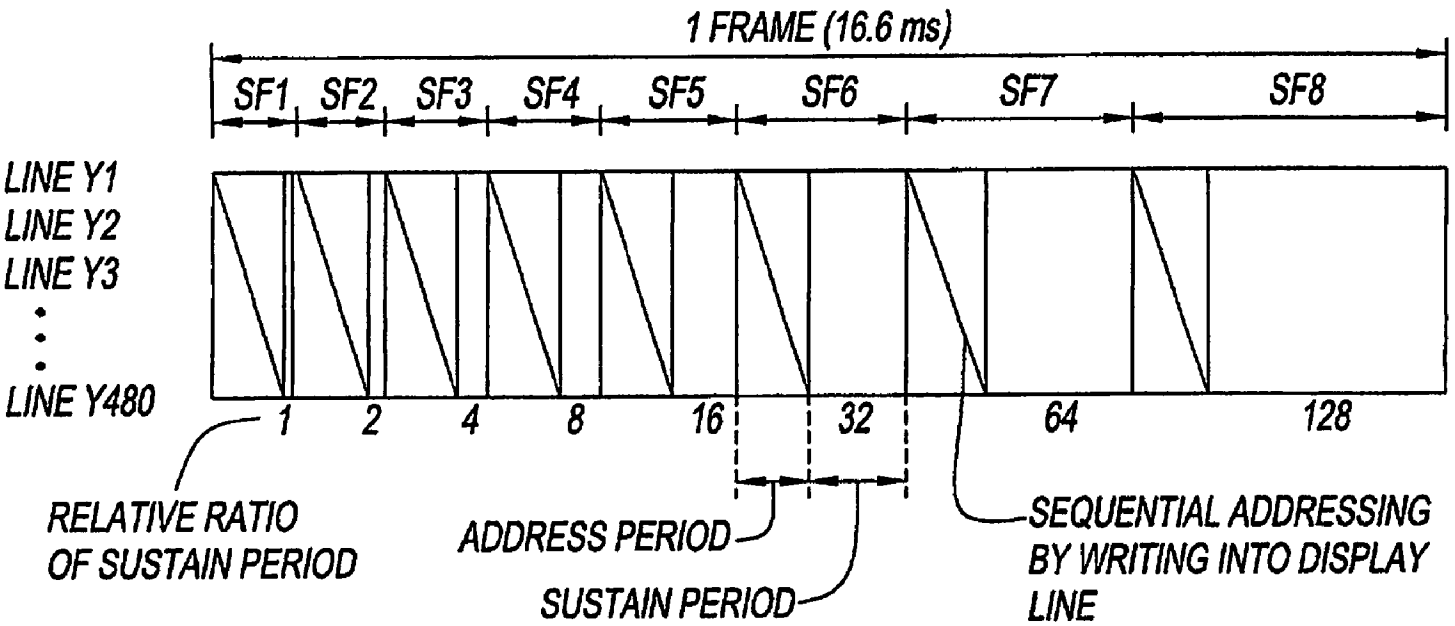
FIG. 3 (Prior Art)
FIG. 3 is graph showing the division of frame time into 8 subfields.
Figure 4:
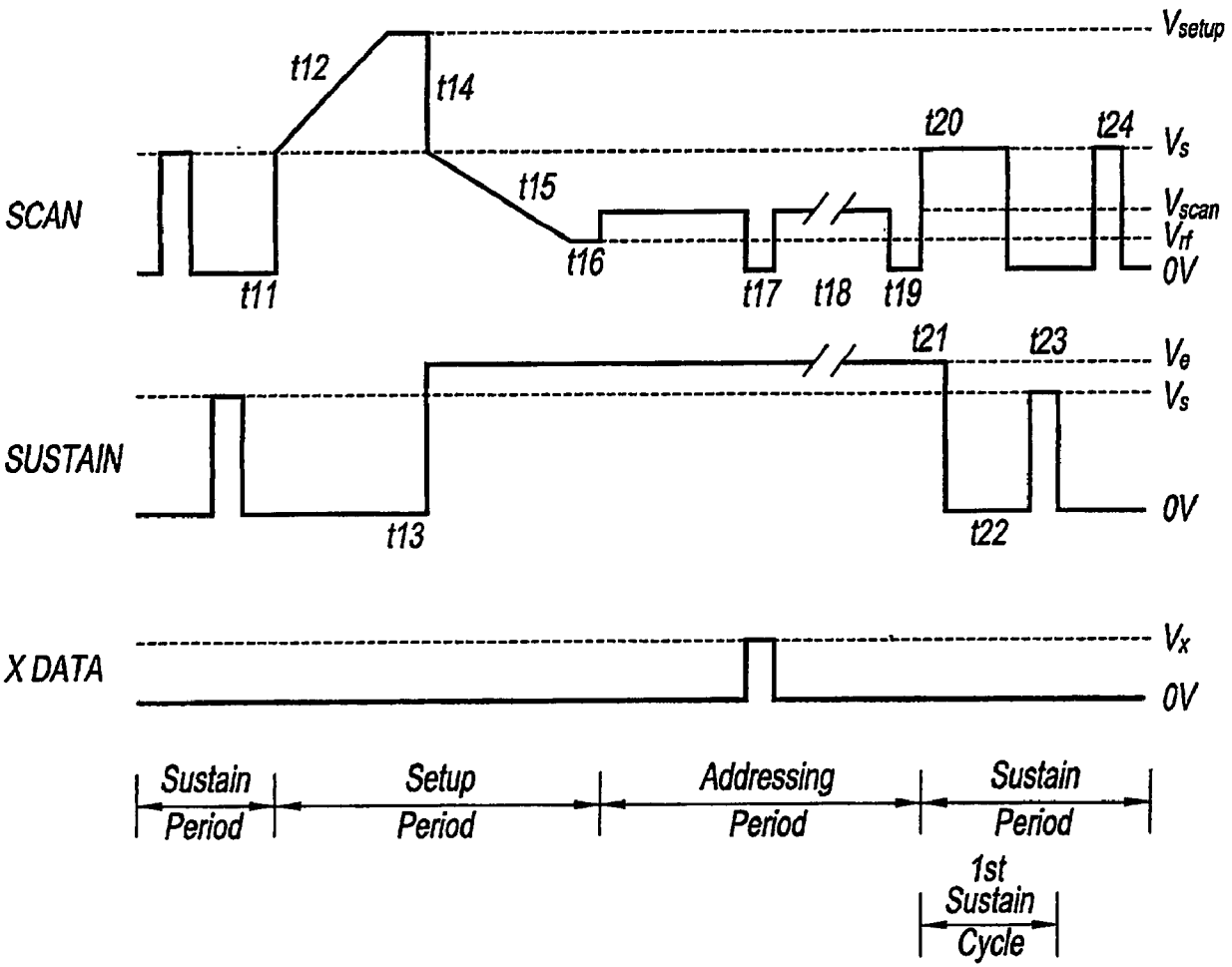
FIG. 4 (Prior Art)
FIG. 4 is a graph of conventional subfield waveforms.
Figure 5:
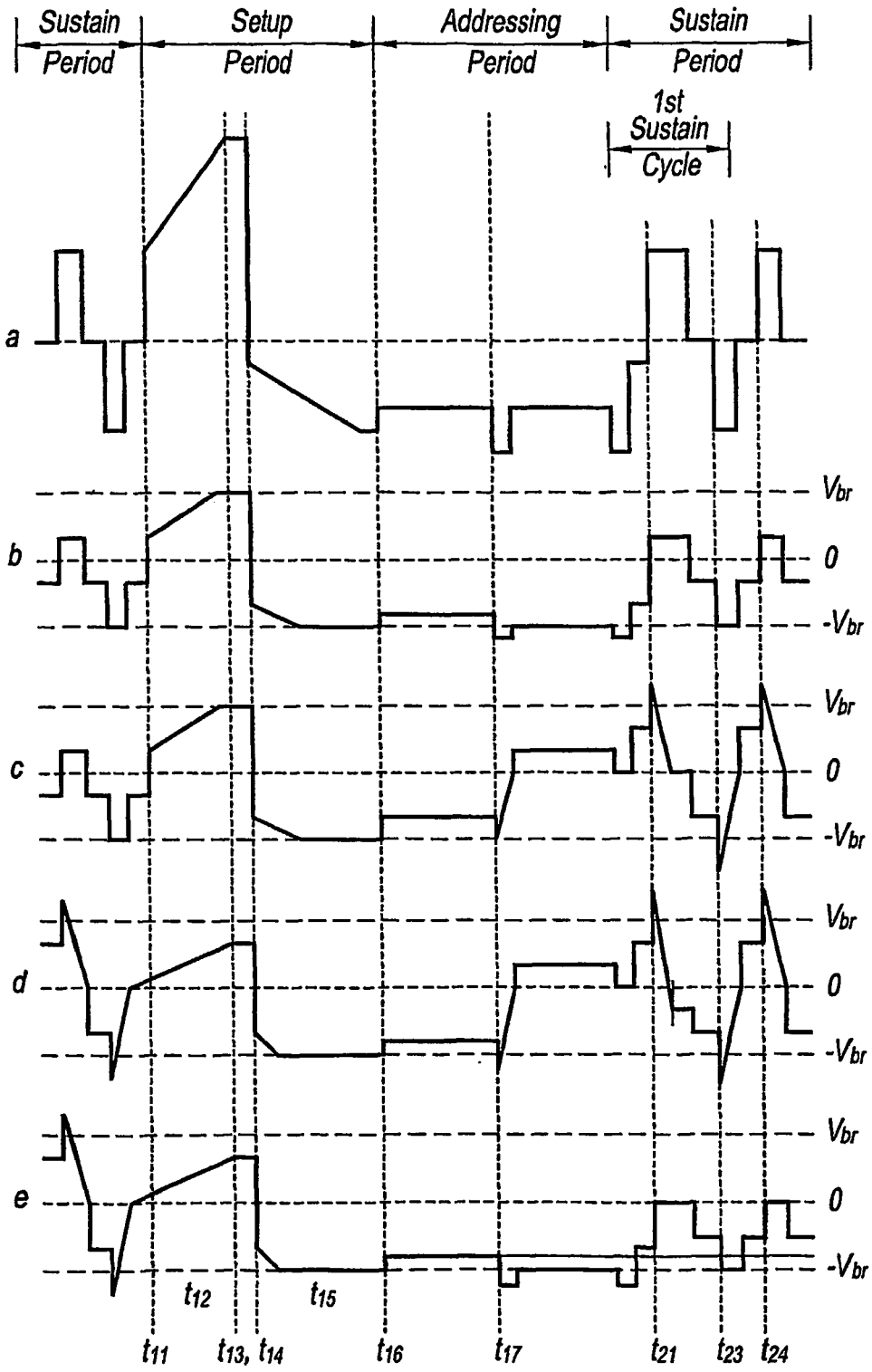
FIG. 5 (Prior Art)
FIG. 5*a* is a graph of a conventional composite waveform between a scan electrode and a sustain electrode.
FIGS. 5*b*-5*e* are graphs of conventional cell voltage waveforms for pixel addressing sequences.
Figure 6:
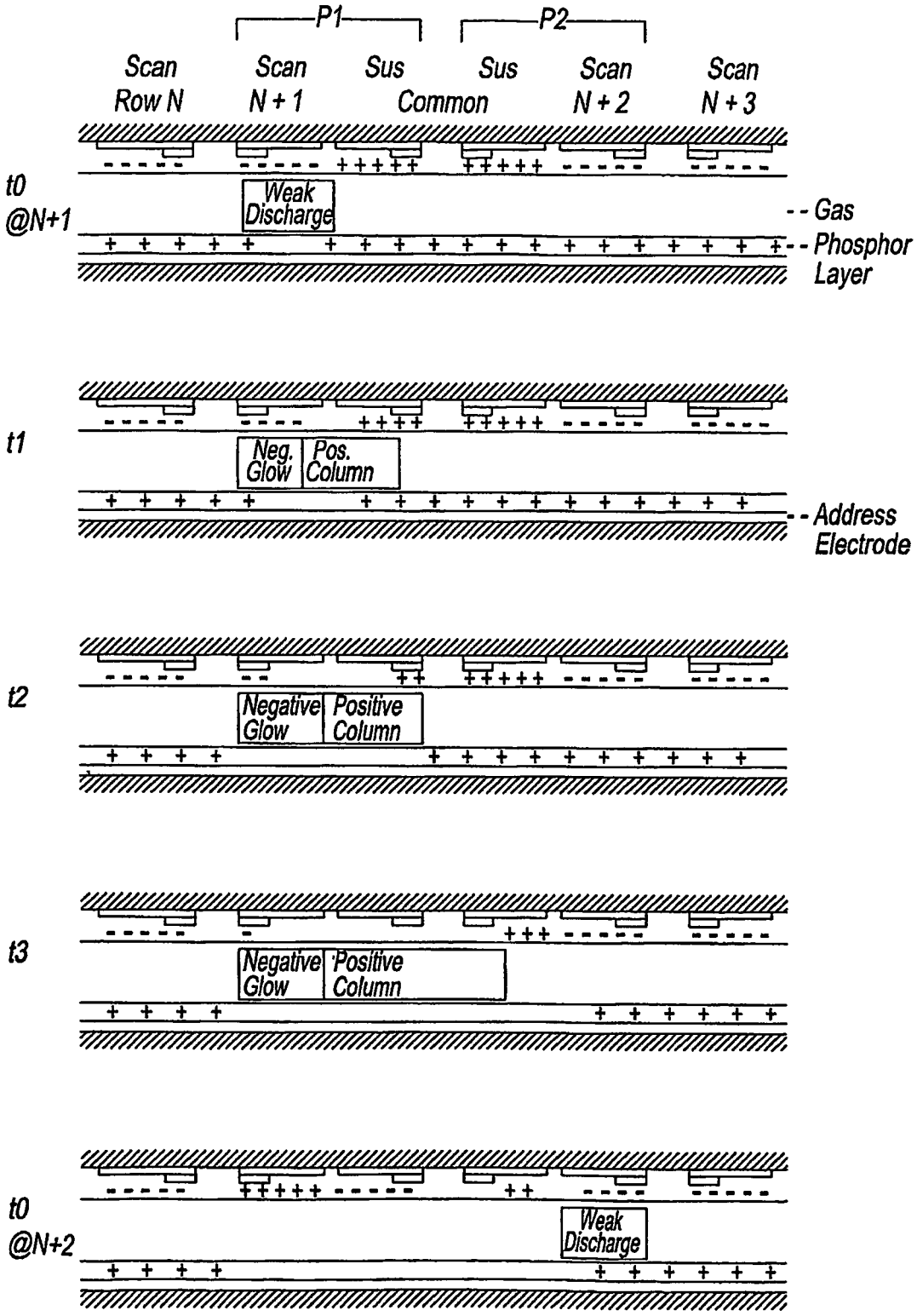
FIG. 6 (Prior Art)
FIG. 6 is a schematic representation of discharge mechanics for an address discharge showing crosstalk discharge for the PDP of FIG. 1.

Sustain generator 825 operates in the same manner as sustain generator 220 (FIG. 2), but supplies voltage Ve to even/odd selector 820 during addressing.

Even/odd selector 820 is a circuit that employs a method for controlling sustain electrodes in a PDP. The method includes (a) enabling a first sustain electrode to produce an addressing discharge, and (b) disabling a second sustain electrode when the first sustain electrode is producing the addressing discharge, where the first sustain electrode is adjacent to the second sustain electrode.

Even/odd selector 820 controls even sustain electrodes $\mathbf{710}_E$ and odd sustain electrodes $\mathbf{710}_O$. It supplies an isolation voltage (Viso) to even sustain electrodes $\mathbf{710}_E$ via an output to sustain driver line $\mathbf{817}_E$, and supplies Viso to odd sustain electrodes $\mathbf{710}_O$ via an output to sustain driver line $\mathbf{817}_O$. The purpose of Viso is further explained below.

Figure 9:
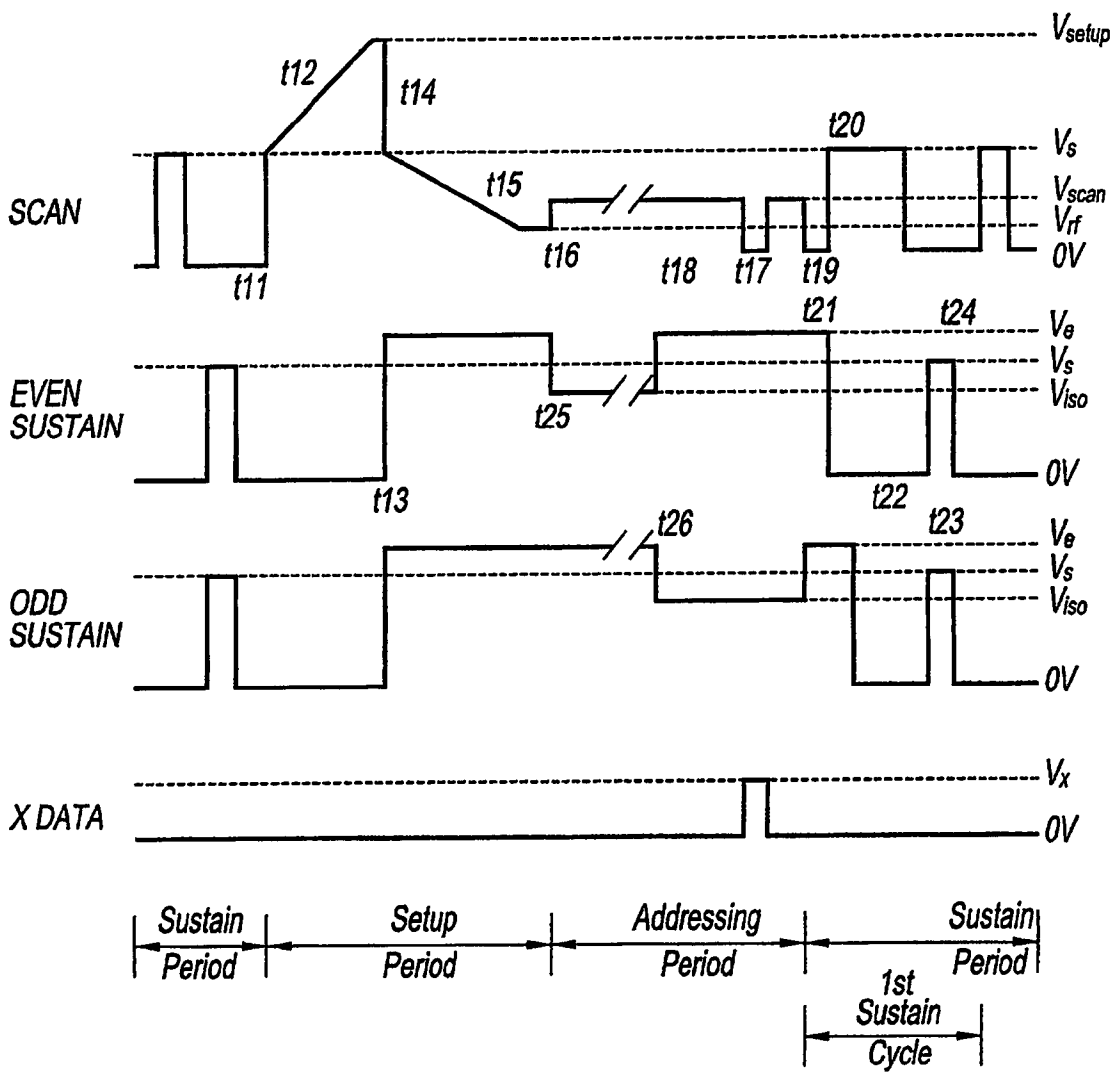
FIG. 9 is a graph of even and odd sustain electrode waveforms for a PDP employing vertical crosstalk suppression.

FIG. 9 is a graph of even and odd sustain electrode waveforms during an addressing of an even row at time t17 (odd rows are isolated at t17). Assume that the waveforms are for scan electrode $\mathbf{714}_n$, even sustain electrode $\mathbf{710}_E$ and odd sustain electrode $\mathbf{710}_O$. The X Data waveform represents an output of column driver 830 to one of column driver lines $\mathbf{840}_R$, $\mathbf{840}_G$ and $\mathbf{840}_B$. Typical operating voltages for the PDP of FIG. 7 operated with the waveforms of FIG. 9 would be a setup voltage Vsetup of 400V, a sustain voltage Vs of 180V, a Vscan voltage of 120V, a ramp bias voltage Vrf of 10V, a setup/erase voltage Ve of 220V, an isolation voltage Viso of 0 to 120V (Viso is typically at least 60 volts below voltage Ve), and a data voltage Vx of 65V.

The voltage on even sustain electrode $\mathbf{710}_E$ is referenced to a voltage on scan electrode $\mathbf{714}_n$. The voltage on odd sustain electrode $\mathbf{710}_O$ is referenced to a voltage on scan electrode $\mathbf{714}_{n+1}$. These references are established during the setup period. During the setup period, even/odd selector 820 provides Ve to, and thus enables, both even sustain electrode $\mathbf{710}_E$ and odd sustain electrode $\mathbf{710}_O$.

At t25, the addressing period begins, and even/odd selector 820 reduces the voltage supplied to even sustain electrode $\mathbf{710}_E$ to Viso thus reducing the difference of voltage, and therefore the magnitude, between even sustain electrode $\mathbf{710}_E$ and scan electrode $\mathbf{714}_n$. This disables the even bank for the first half of the addressing period. Note that during the first half of the addressing period, odd sustain electrode $\mathbf{710}_O$ is enabled. At time t26, even/odd selector 820 restates the voltage on even sustain electrode $\mathbf{710}_E$ to Ve, and reduces the voltage on odd sustain electrode $\mathbf{710}_O$ to Viso, thus reducing the magnitude of the difference in voltage between odd sustain electrode $\mathbf{710}_O$ and scan electrode $\mathbf{714}_{n+1}$. Thus, at time t26 the even and odd banks switch roles for the second half of the addressing period so that the odd bank is disabled and the even bank is enabled. At time t17, during the second half of the addressing period, even sustain electrode $\mathbf{710}_E$ produces an addressing discharge to scan electrode $\mathbf{714}_n$. Crosstalk between even sustain electrode $\mathbf{710}_E$ and odd sustain electrode $\mathbf{710}_O$ is suppressed by the lower potential (i.e., Viso) on odd sustain electrode $\mathbf{710}_O$ at time t17. This is because the enabling voltage Ve on even sustain electrode $\mathbf{710}_E$ is referenced to the voltage on scan electrode $\mathbf{714}_n$, and the disabling voltage Viso on odd sustain electrode $\mathbf{710}_O$, when referenced to the voltage on scan electrode $\mathbf{714}_n$ is a lower magnitude than the enabling voltage Ve. Similarly, the row select and the respective column data are synchronized by logic block 835 to sequence through the odd rows first followed by the even rows.

In FIG. 9, a negative pulse on scan electrode $\mathbf{714}_n$ during the addressing period indicates the time at which a particular pixel is addressed. Such a pulse occurs at time t17. Note that also at time t17 even sustain electrode $\mathbf{710}_E$ is at Ve (and therefore enabled) while odd sustain electrode $\mathbf{710}_O$ is at Viso (and therefore disabled). Accordingly, the waveforms in FIG. 9 are for a case of addressing an even row in PDP 815, and more particularly, row "n".

In the first sustain cycle, at time t20 there is a rising edge for the voltage on scan electrode $\mathbf{714}_n$, and at t21 there is a falling edge for the voltage on even sustain electrode $\mathbf{710}_E$. The addressing discharge that was produced by even sustain electrode $\mathbf{710}_E$ at time t17 allows even sustain electrode $\mathbf{710}_E$ to produce a first sustain discharge during time t22.

Figure 10:
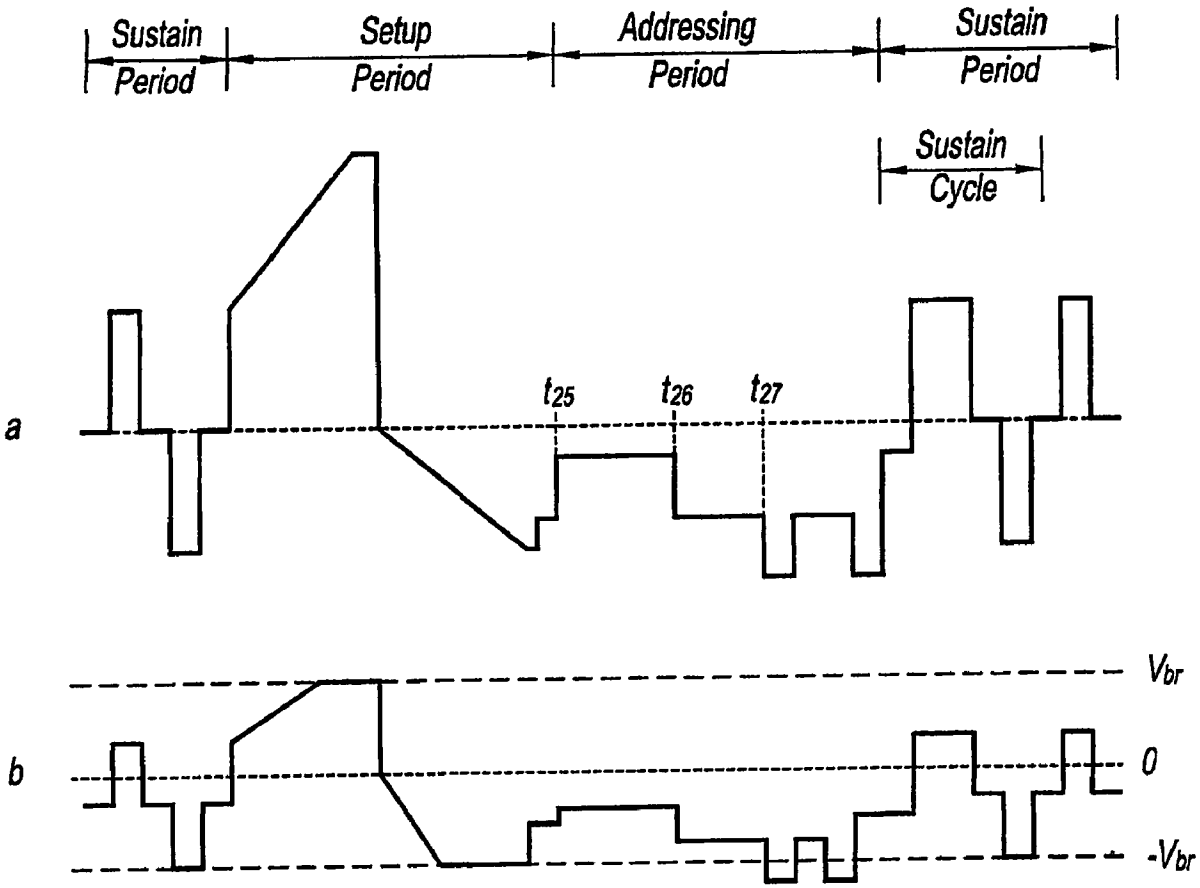
FIG. 10*a* is a graph of a composite waveform.
FIG. 10*b* is a graph of a cell voltage waveform, for an even bank of electrodes.

FIG. 10*a* is a graph of a composite waveform of the scan waveform and even sustain waveform of FIG. 9, and FIG. 10*b* is a graph of a cell voltage waveform, for an OFF sub-pixel on the even bank of electrodes. Since the graph is that of an off sub-pixel, the breakdown voltage is only exceeded during the two setup ramps where the cell voltage is limited to Vbr and −Vbr, approximately ±200V.

The composite waveform is formed by subtracting the sustain electrode voltage from the scan electrode voltage. Assume for example, a case of even sustain electrode $\mathbf{710}_E$ and scan electrode $\mathbf{714}_n$. Reducing voltage on even sustain electrode $\mathbf{71}_E$ from Ve to Viso at t25 for the first half of the addressing period causes an increase in the composite voltage and thereby reduces the voltage across the gas. When the voltage on even sustain electrode $\mathbf{710}_E$ is increased from Viso to Ve during the second half of the addressing period, the cell voltage returns close to the breakdown voltage −Vbr, so that the application of the row select pulse at t17 slightly exceeds the breakdown voltage −Vbr.

Figure 11:
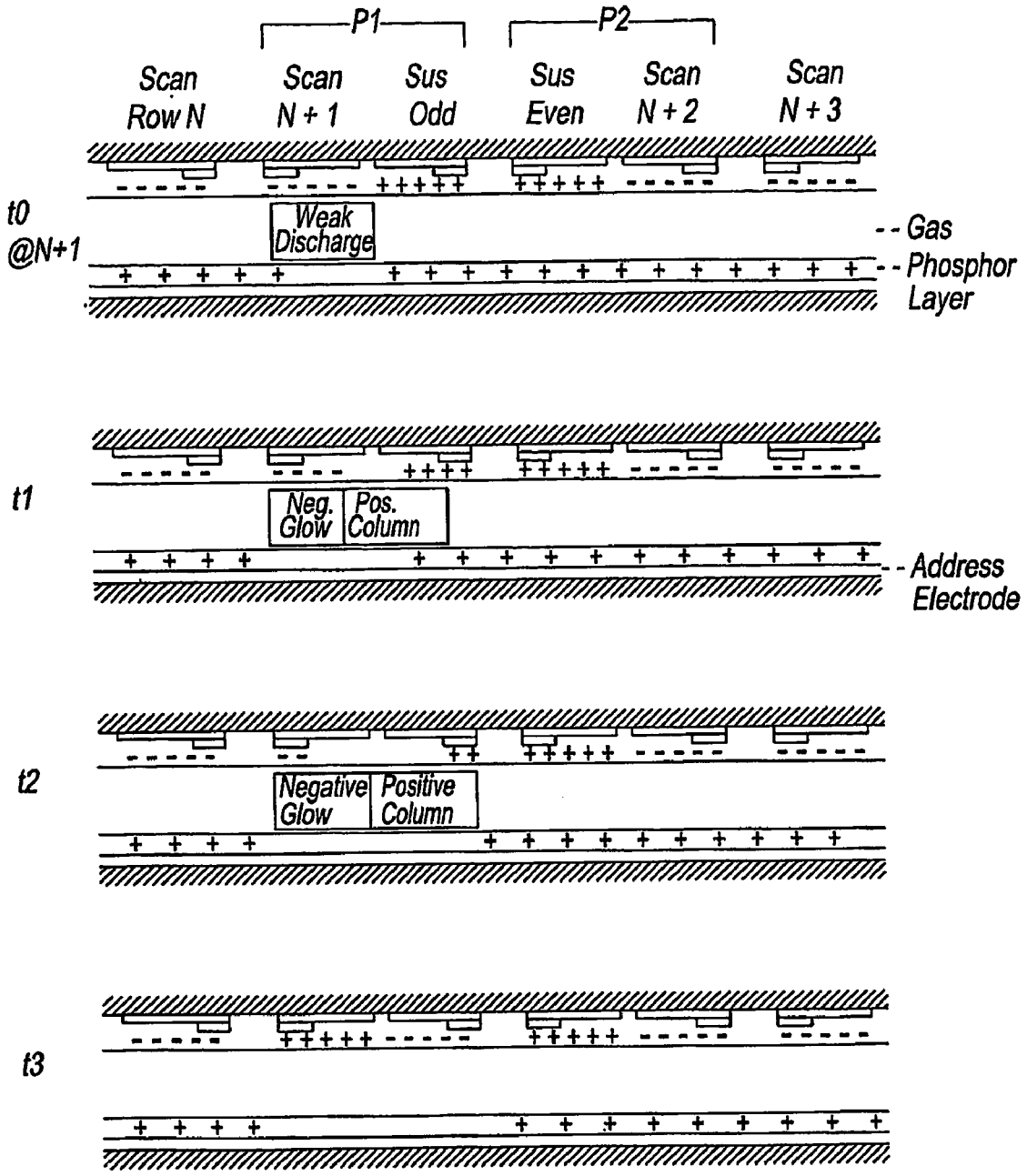
FIG. 11 is a schematic representation of a cross-sectional view of the odd pixel discharge mechanics.
Figure 12:
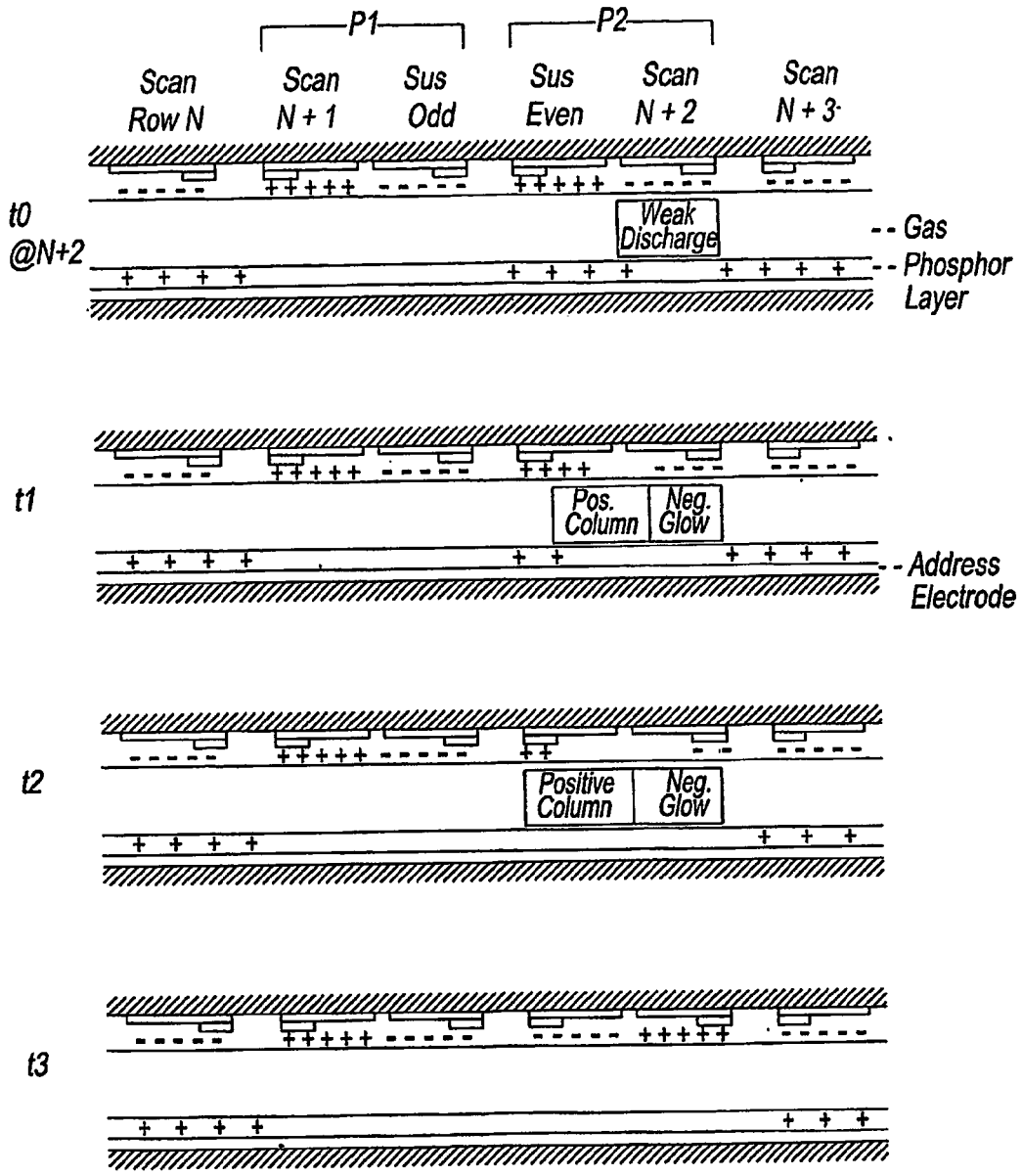
FIG. 12 is a schematic representation of a cross-sectional view of the even pixel discharge mechanics.

FIGS. 11 and 12 show cross sectional views of pixel addressing discharge mechanics. More particularly, FIG. 11 shows the addressing discharge mechanics for an odd pixel P1, and FIG. 12 shows a neighboring even pixel P2. In FIG. 11, P1's sustain electrode is tied to the enabled odd sustain bank, and is at a higher voltage, Ve, than the disabled even sustain electrode, at voltage Viso. The P1 address discharge is initiated via an applied data pulse, however, the reduced positive voltage on the even sustain electrode reduces the tendency of the positive column to spread into the P2 pixel space. The lower the Viso voltage applied to the even electrode, the greater the isolation achieved.

The address discharge on P1 reverses the wall charge on the dielectric surfaces of the pixel site; therefore, disabling the odd bank for the second half of addressing will result in an even greater isolation effect from the P2 address discharge. Enabling the even sustain electrodes returns them to their full positive voltage so that when P2 is selected and a discharge forms, there is sufficient positive voltage on P2's sustain electrode available to form a strong address discharge.

Figure 13:
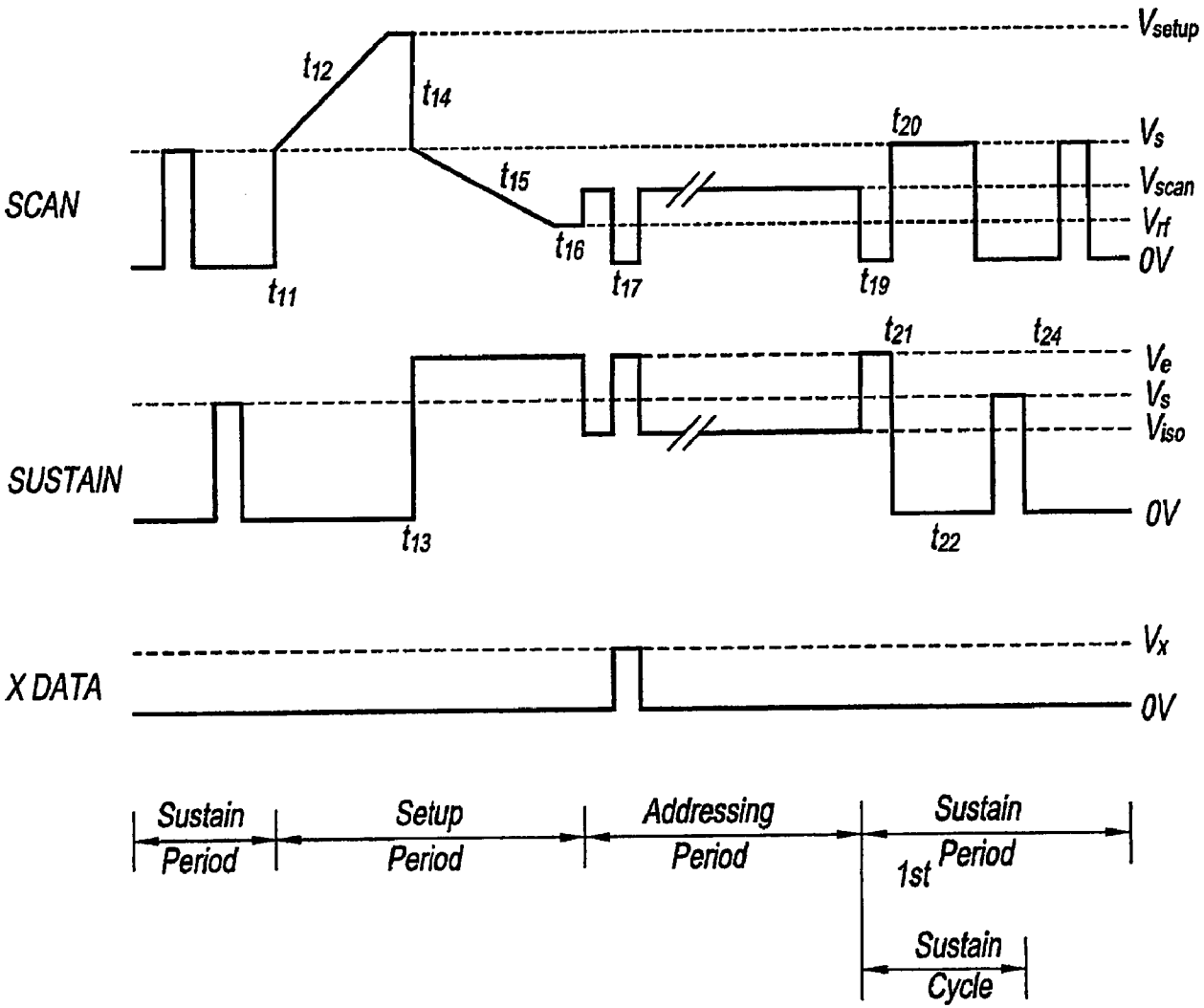
FIG. 13 is a graph of waveforms in a system utilizing sequential addressing wherein sustain electrodes are enabled in conjunction with their corresponding scan electrodes.

FIG. 13 is a graph of scan and sustain electrode waveforms for a PDP where the voltage on the sustain electrodes is reduced to Viso to provide cell-to-cell isolation. As each row is sequentially selected on the scan side by a negative row select pulse at t17, a corresponding sustain electrode is returned to the sustain side addressing voltage Ve, thus providing a positive row select on the sustain side. Such an embodiment may be realized through the use of row drivers on the sustain side in place of even/odd selector 820 of FIG. 7.

Figure 14:
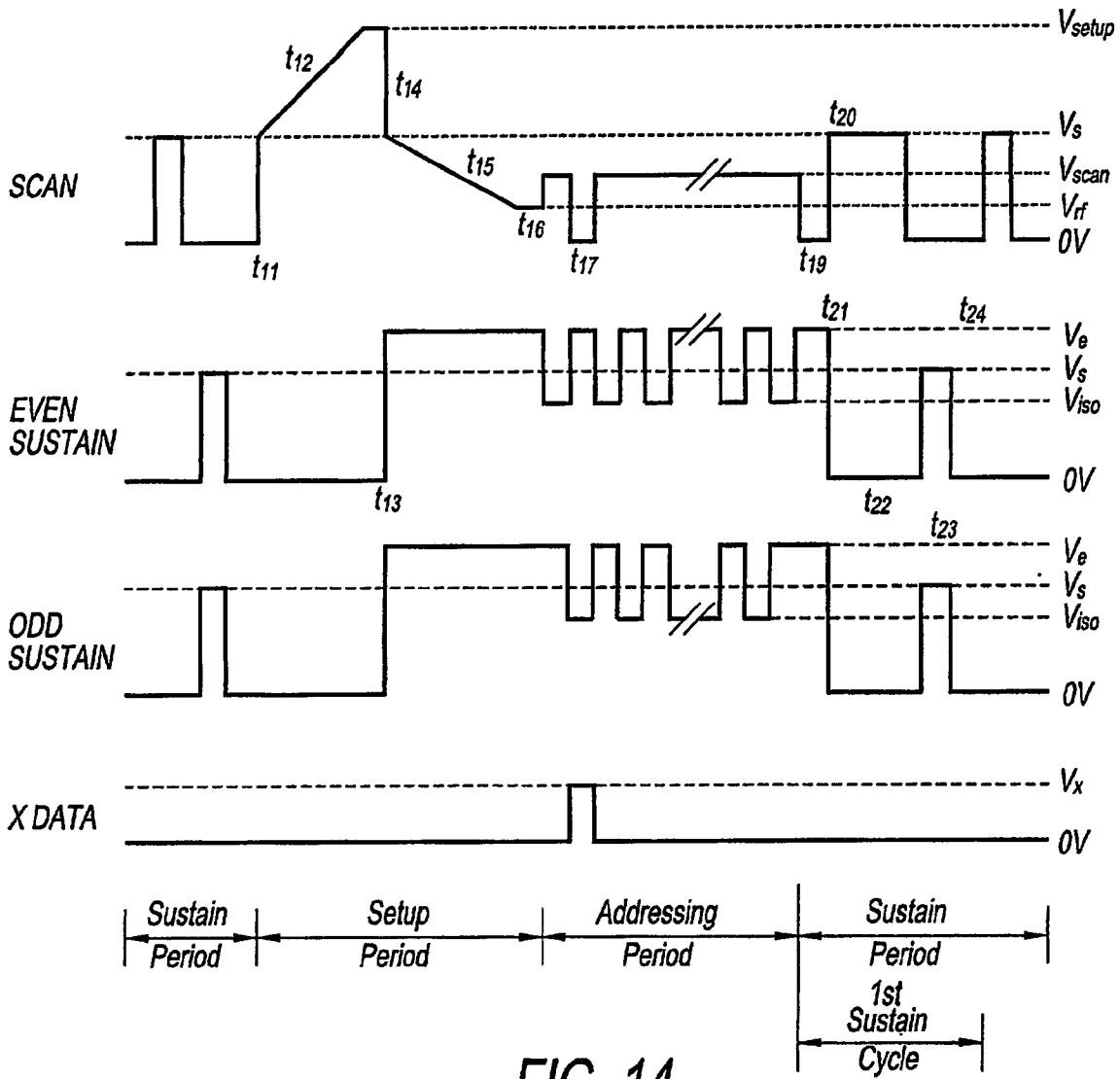
FIG. 14 is a graph of even and odd sustain electrode waveforms for a PDP, where the sustain electrodes are separated into odd and even sustain buses.

FIG. 14 is a graph of even and odd sustain electrode waveforms for a PDP where the sustain electrodes are separated into odd and even sustain buses. Row drivers 810 provide sequential negative going row select pulses during the addressing period, while the sustain electrode voltage alternates between Viso and Ve as the row select pulse is applied to each scan electrode. In FIG. 14, at time t17 there is a selection of an odd row, as the even sustain electrodes are driven to the isolation voltage Viso, while the odd sustain electrodes are driven to the sustain side addressing voltage Ve.

Figure 15:
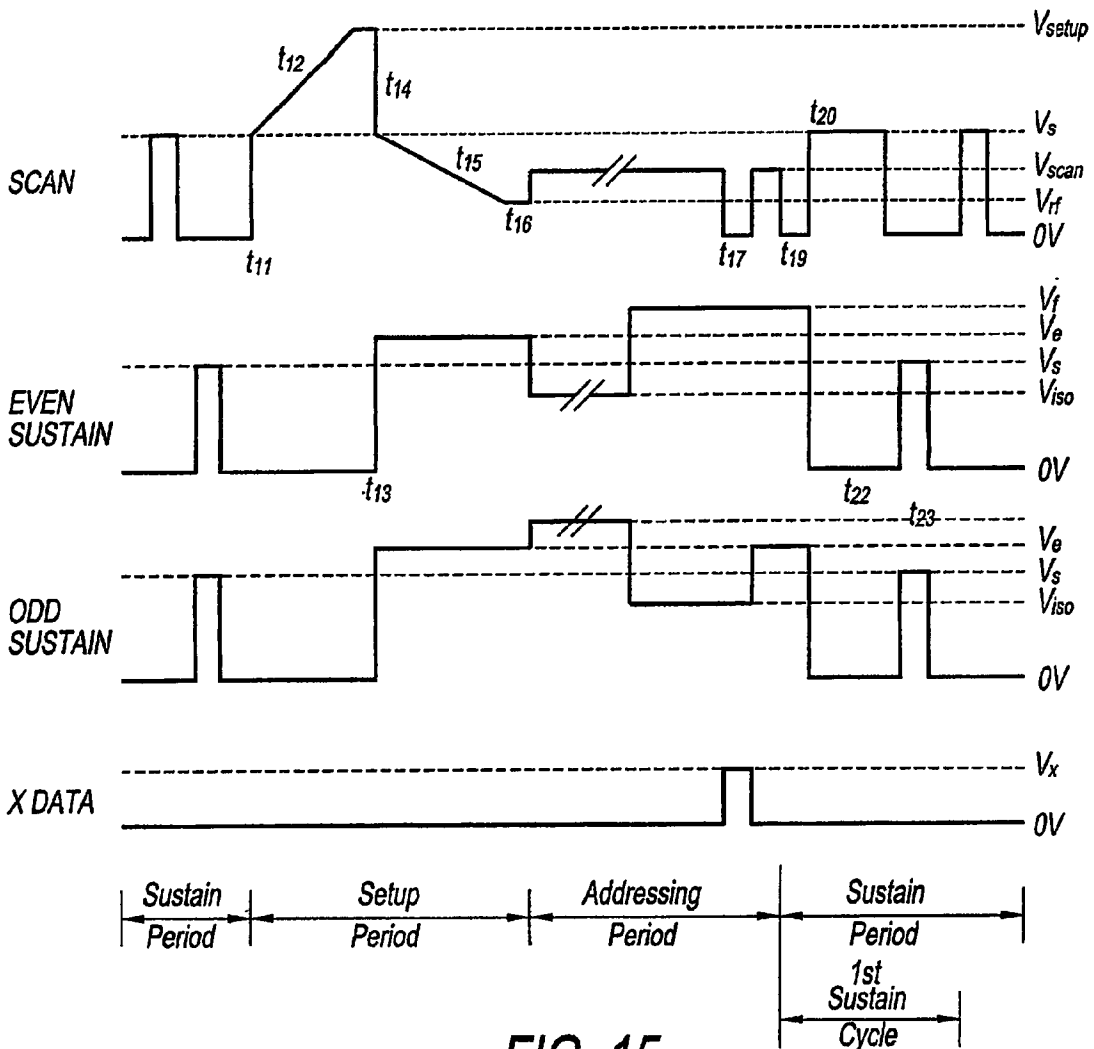
FIG. 15 is a graph of even and odd sustain electrode waveforms for a PDP, where an increased voltage Vf is applied to the odd or even sustain electrode buses.

FIG. 15 is a graph of even and odd sustain electrode waveforms for a PDP, where an increased forward voltage Vf of typically 10V higher than voltage Ve is applied to the odd or even sustain electrode buses. This arrangement provides additional voltage across the pixel to improve the panel's addressing margin by increasing the charge transfer of the address discharge. Utilization of forward voltage Vf may also be applied to the waveforms of FIGS. 13 and 14.

Figure 16:
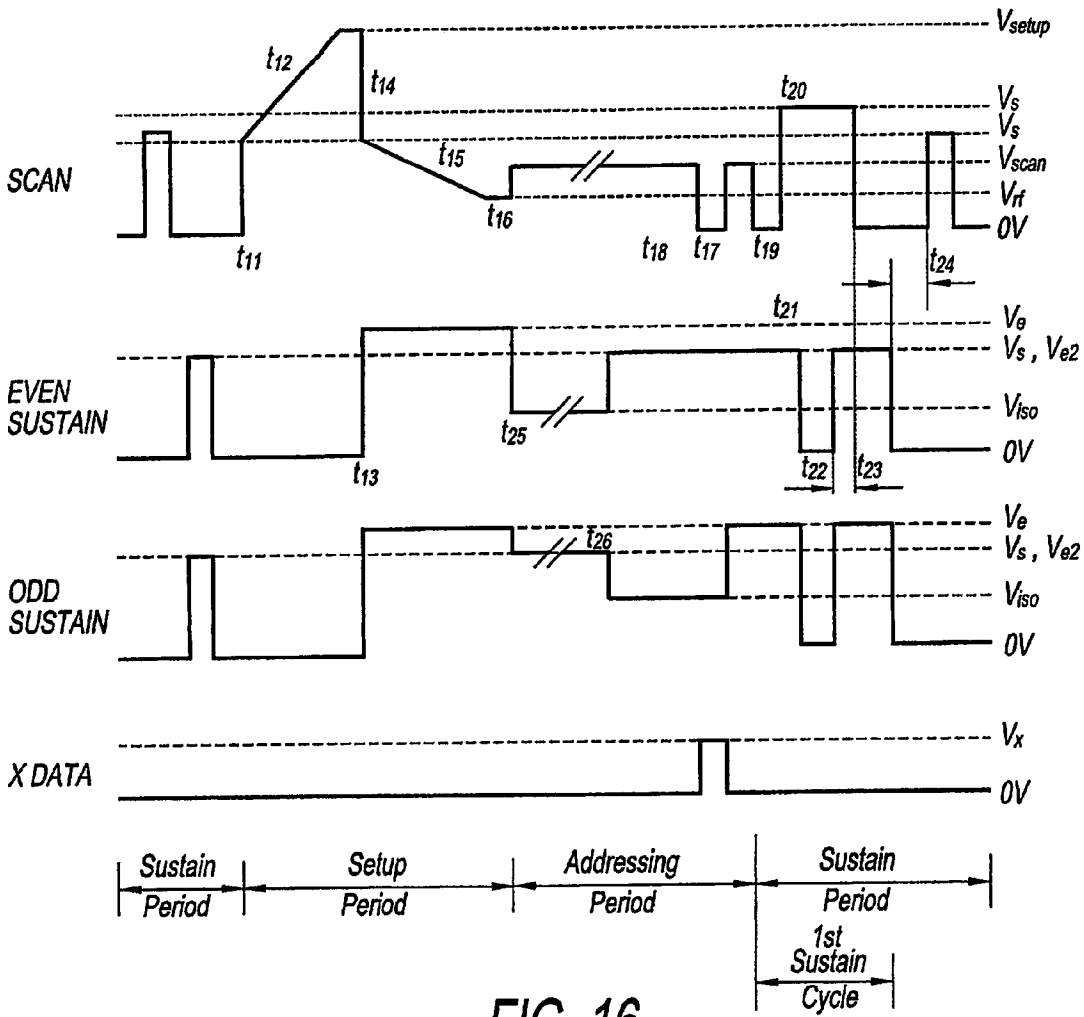
FIG. 16 is a graph showing waveforms where a voltage applied to a sustain electrode is reduced from a setup voltage Ve to a voltage Ve2 at, or near, a sustain voltage Vs at a time of transition between a setup period and an addressing period, and where a voltage Vs1 is introduced to strengthen the first sustain discharge.

FIG. 16 is a graph showing waveforms where a voltage applied to a sustain electrode is reduced from a setup voltage Ve to a voltage Ve2 at, or near, a sustain voltage Vs, at a time of transition between a setup period and an addressing period. For example, Ve2=Vs±20%. The waveforms in FIG. 16 are for a scan voltage, an even sustain voltage, an odd sustain voltage and an X data voltage. These waveforms are indicative of voltages applied to an even sub-pixel and an odd sub-pixel. However, the scan voltage in FIG. 16 has a low-going row select pulse at time t17, which coincides with the even sustain electrode being at voltage Vs and the odd sustain electrode being disabled by voltage Viso. Therefore the scan electrode shown in FIG. 16 is paired with the even sustain electrode and shows an addressing of the even sub-pixel. A pulse on the X data electrode at time t17 triggers an address discharge of the even sub-pixel. As explained below, the arrangement of waveforms in FIG. 16 performs an addressing operation at a voltage Ve2 that is less than setup voltage Ve to weaken the address discharge, and applies a boost voltage Vs1 to the scan electrode to produce and strengthen an initial sustain discharge. The weaker address discharge is less likely to bridge the interpixel gap, where such a bridge would otherwise cause crosstalk. The boost voltage applied to the scan electrode during the first sustain discharge compensates for the weak address discharge.

Just prior to time t25, during the setup period, the voltage on all odd and all even sustain electrodes is at a voltage Ve. On the scan electrode, the application of a falling ramp at time t15 in conjunction with Ve being applied to the sustain electrodes produces a slow set up discharge at all sub-pixels in the display with a cell voltage equal to the gas breakdown voltage, −Vbr. More, or less, charge can be placed on each dielectric layer as voltage Ve is decreased or increased, respectively. Considering the even sustain electrode voltage represented in FIG. 16, at time t25, the even sustain electrode is deselected by applying an isolation voltage Viso thereto. Although not shown in FIG. 16, the odd sustain electrode is addressed at some time between time t25 and time t26 when a row select pulse (similar to the pulse shown at time t17) is applied to the odd sustain electrode's corresponding scan electrode, in conjunction with an X data pulse.

At time t26, the even sustain electrode is enabled for addressing with an application of a voltage Ve2, at or near Vs. By placing the even sustain electrode at a voltage Ve2 that is less than the setup voltage Ve applied during the setup period prior to t25, less of a difference in voltage exists between the even sustain electrode and its associated scan electrode. That is, the cell voltage is reduced away from the gas breakdown voltage. Also at time t26, the odd sustain electrode is driven to the isolation voltage Viso, thereby deselecting the odd sustain electrode.

As previously described, the X data pulse initiates a discharge between the X data electrode and the scan electrode bearing the row select pulse. At time t17, there is an addressing operation involving the even sustain electrode, where the address discharge propagates from the scan electrode to the even sustain electrode. The strength of the address discharge at t17 is proportional to the voltage between the scan electrode and the even sustain electrode. The greater the difference between the voltage applied to the even sustain electrode during setup (Ve) and the voltage applied for addressing (Ve2), then at time t17, the lesser is the difference between the voltage (Ve2) on the even sustain electrode and the voltage (0V) on the scan electrode, and the weaker the discharge will be between the even sustain electrode and its scan electrode. The weakened address discharge in conjunction with the presence of the isolation voltage Viso on the neighboring odd sustain electrode, prevents the address discharge from bridging the inter-pixel gap, even in a case of a very small interpixel gap, e.g., less than 200 microns.

A boost voltage Vs1, which is greater than the standard sustain voltage Vs, is applied to the scan electrode at time t20. At time t21, the sustain electrodes are returned to 0V, initiating the first sustain discharge. During time interval t22, in the first sustain cycle, an initial sustain discharge occurs at all sub-pixels that were addressed during the addressing period. For example, in FIG. 16, an initial sustain discharge occurs at time t21 as the voltage on the even sustain electrode transitions from Ve2 to 0V. The larger voltage, i.e., Vs1, applied to the scan electrode during the first sustain discharge in the first sustain cycle compensates for a reduced wall charge transfer that occurred during the address discharge at time t17 because the voltage on the even sustain electrode was reduced from Ve to Ve2. For the remainder of the sustain period, after the first sustain cycle, the scan electrodes are driven to Vs rather than Vs1 during discharging of their corresponding sustain electrodes.

Following the initial sustain discharge during time interval t22, the sustaining voltage Vs is applied to the sustain electrodes prior to the removal of the Vs1 voltage from the scan electrodes. Time intervals t23 and 24 are transition intervals. For example, in FIG. 16, after the initial sustain discharge during time interval t22, during time interval t23 the voltage on the even sustain electrode transitions from 0V to Vs. More particularly, during time interval t23 the voltages on the even and odd sustain electrodes transition from 0V to Vs, and the voltage on the scan electrode transitions from Vs1 to 0V, initiating a second sustain discharge. During time interval t24, the voltages on the even and odd sustain electrodes transition from Vs to 0V, and the voltage on the scan electrode transitions from 0V to Vs. The second sustain discharge occurs after the end of time interval t23 and before the beginning of time interval t24. Overlapping the sustain pulse edges during time interval t23, that is by concurrently driving both the even and odd sustain electrodes from 0V to Vs, prevents a premature discharge from occurring with the removal of Vs1 prior to applying Vs to the sustain electrodes. With the overlap, the second discharge occurs with the fall of the scan electrode voltage at the end of time interval t23. However, with the lower sustain voltage Vs applied to the sustain electrodes during time interval t23, the transitions during time interval t24 need not be overlapped.

While the usage of the boost voltage Vs1 is to compensate for the voltage reduction of the sustain electrodes from voltage Ve applied during setup to voltage Ve2 during addressing, such a usage of boost voltage Vs1 may also be applied in a PDP apparatus that does not employ the voltage reduction of Ve to Ve2 in an effort to increase the strength of the first sustain discharge.

Like the address discharge, due to the time delay from addressing causing a lack of discharge priming, and like the inherent weakness and variability in the address discharges themselves, the first sustain discharge is also slow to develop. As the first sustain discharge forms a positive column spreads across the sub-pixel site's scan electrode. If the site across the scan electrode inter-pixel gap was addressed, and whose first sustain discharge is slightly delayed, the positive column of the first discharging site can spread across the inter-pixel gap and prevent the neighboring site from discharging. Thus, the first sustain discharge may exhibit a similar vertical crosstalk failure mechanism as in addressing where the positive column spreads across the inter-pixel gap separating adjacent scan electrodes. Accordingly, a first sustain discharge crosstalk suppression technique may be employed similarly to the vertical crosstalk suppression technique employed during the addressing period.

Figure 17:
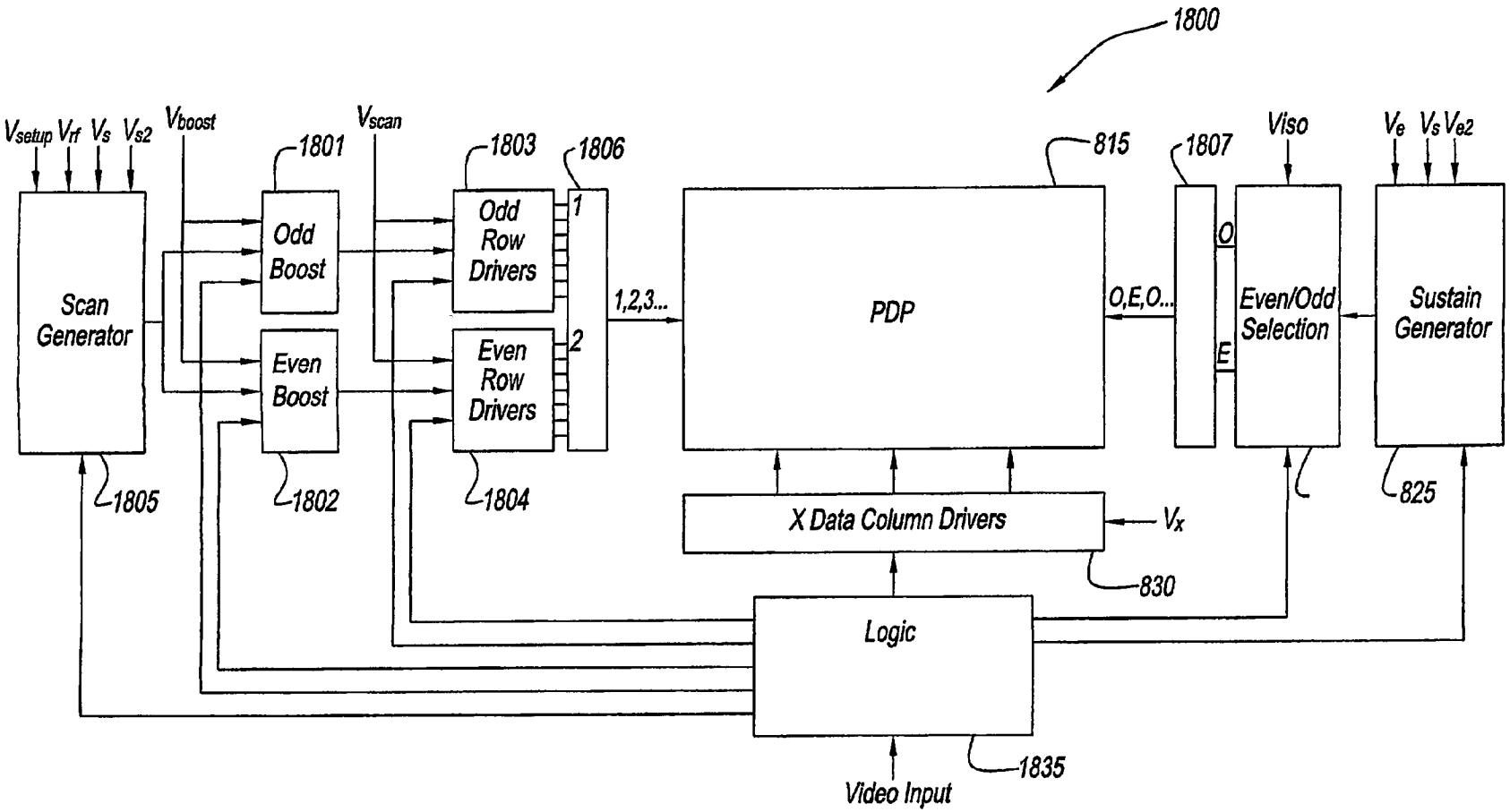
FIG. 17 is a block diagram of a PDP system with circuitry that utilizes an isolation voltage to provide first sustain vertical crosstalk suppression, thus preventing a positive column of a first sustain discharge from spreading across a scan electrode pair inter-pixel gap by reducing voltage on a neighboring scan electrode during the first sustain discharge.

FIG. 17 is a block diagram of a PDP system 1800, incorporating first sustain crosstalk suppression that separates the first sustain discharge into two separate discharges, i.e., a discharge of the odd rows and a discharge of the even rows.

Figure 18:
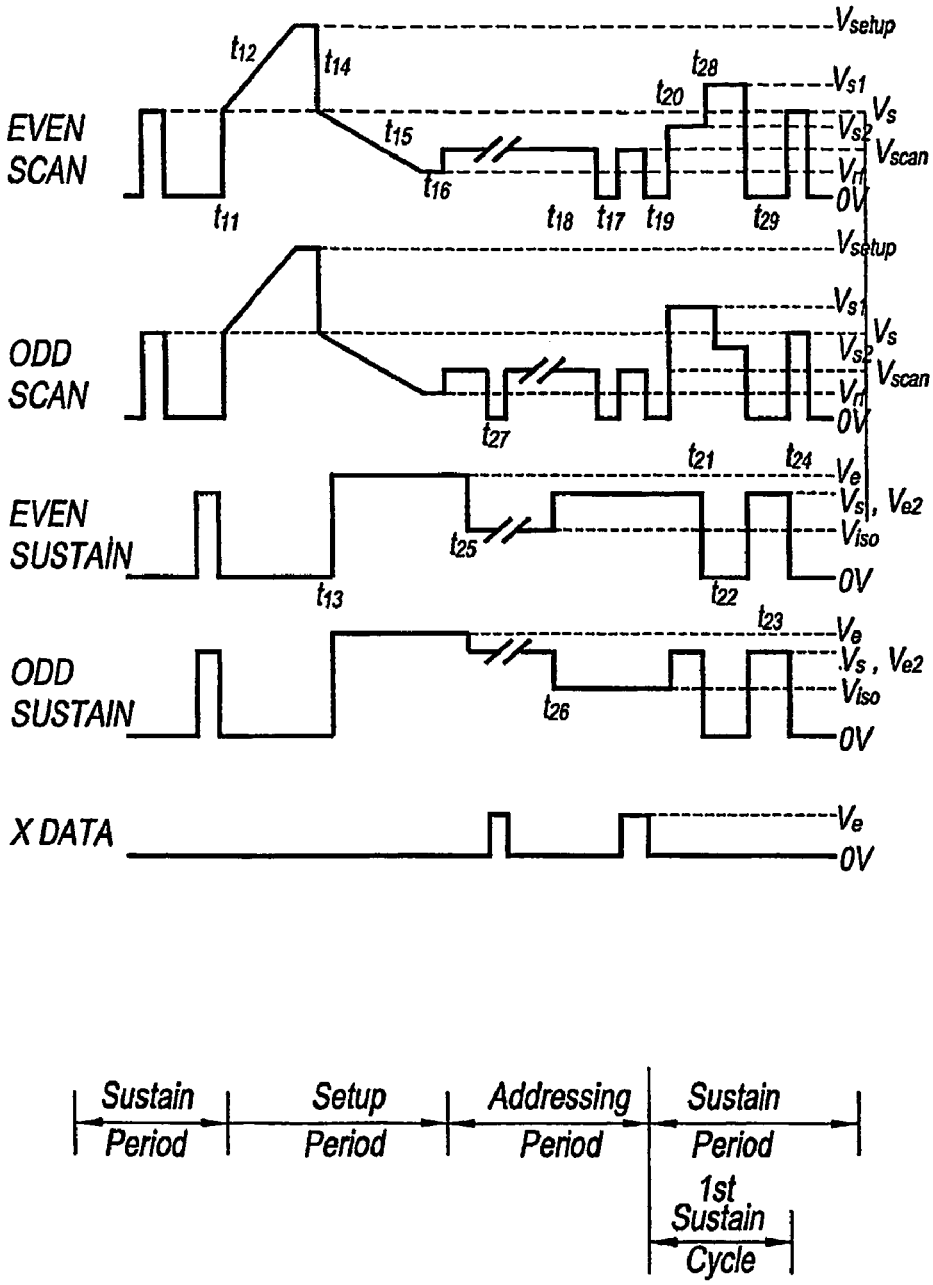
FIG. 18 is a graph of waveforms produced by the circuitry of FIG. 17.

FIG. 18 is a graph of waveforms produced by the circuitry of FIG. 17. More specifically, FIG. 18 shows waveforms for an even scan electrode, an odd scan electrode, an even sustain electrode, an odd sustain electrode and an X data electrode. FIG. 18 shows a boost technique, similar to that of FIG. 16, applied separately to the odd scan electrodes followed by the even scan electrodes between times t20 and t29.

As in system 800, which employs the technique of vertical crosstalk suppression during the addressing period, system 1800 utilizes a voltage isolation to prevent a positive column of a first sustain discharge from spreading across a scan electrode pair inter-pixel gap by reducing voltage on a neighboring scan electrode. A higher voltage is applied to one scan electrode in the pair while a lower isolation voltage is applied to a neighboring electrode. After the discharge occurs, the voltages can alternate to discharge the other scan electrode thereby dividing the first sustain discharge into two discharges. For example, a discharge of the even rows followed by a discharge of the odd rows, or a discharge of the odd rows followed by a discharge of the even rows.

System 1800 includes a PDP 815, and circuitry for even/odd selector 820, column drivers 830, and sustain generator 825, as previously described for system 800. System 1800 further includes circuitry for a scan generator 1805, an odd boost driver 1801, an even boost driver 1802, odd row drivers 1803, even row drivers 1804, multiplexers 1806 and 1807, and a logic circuit 1835.

Sustain side circuitry is configured with sustain generator 825, even/odd selector 820, and multiplexer 1807. Sustain generator 825 includes a voltage Ve2 to drive the sustain electrodes during the addressing period shown in FIG. 18, while Ve drives the sustain electrodes during the falling ramp of the setup period during time t15. Ve2 can be less than, equal to, or greater than Vs depending on the operating characteristics of PDP 815, while Ve is typically greater than or equal to Vs. Even/odd selector 820, separates the output from sustain generator 825 into even and odd sustain buses so that isolation voltage Viso may be applied independently to either the even or odd sustain buses. Multiplexer 1807 denotes the interdigitation of the odd and even buses into sustain connections to PDP 815.

Logic circuit 1835 controls the operation of system 1800. Logic circuit 1835 is responsible for waveform timing control and video data synchronization between the video input and the display.

Scan generator 1805 generates a base waveform that is used for driving both of the even scan electrodes and the odd scan electrodes. Scan generator 1805 outputs sustain pulses during the sustain period up to a voltage Vs. During the setup period, a rising ramp during time t12 is driven to voltage Vsetup and a falling ramp during time t15 is driven to voltage Vrf.

Odd and even boost drivers 1801 and 1802 receive the waveform from scan generator 1805 and route it to odd row drivers 1803 and even row drivers 1804, respectively. Note that odd and even boost drivers 1801 and 1802 also receive a voltage, i.e., boost voltage Vboost, the purpose of which is further described below. Logic circuit 1835 controls odd and even boost drivers 1801 and 1802. Referring to odd boost driver 1801, logic circuit 1835 controls it to either (a) route the waveform from scan generator 1805 to odd row drivers 1803, or (b) produce a boost voltage Vs1 (see FIG. 18) that is passed to odd row driver 1803. Likewise, logic circuit 1835 controls even boost driver 1802 to either (a) route the base waveform to even row drivers 1804, or (b) produce boost voltage Vs1 for even row drivers 1804.

During the first sustain cycle, scan generator 1805 outputs voltage Vs2. Boost drivers 1801 and 1802 selectively output voltage Vs2 or the boost voltage Vs1 during the first sustain cycle. At all other times boost drivers 1801 and 1802 pass through the waveform produced by scan generator 1805.

Odd row drivers 1803 drive odd rows of scan electrodes, and even row drivers 1804 drive even rows of scan electrodes. Thus, the row drivers are partitioned into even and odd banks. Row drivers 1803 and 1804 drive individual display rows and can switch each of their respective outputs between (a) the output of their respective boost driver 1801, 1802 through a lower output drive transistor (not shown), or (b) a floating version of voltage Vscan, typically 120V, through an upper output drive transistor (not shown). Odd row drivers 1803 float on odd boost driver 1801, and even row drivers 1804 float on even boost driver 1802.

Referring to FIG. 18, between times t25 and t26 the odd rows are addressed sequentially by the odd row drivers, with a given odd row selected at time t27. During this time interval, the even sustain electrodes are suppressed by the isolation voltage Viso, and the even scan electrodes are de-selected by voltage Vscan.

During the addressing period, scan generator 1805 outputs 0V. Also during the addressing period, row drivers 1803 and 1804 output (a) the voltage Vscan to all unselected rows, and (b) at time t17, the voltage 0V, from scan generator 1805, to a selected row. At time t17, on the even scan electrode there is shown a row select pulse, which is generated by the even row drivers 1804. Thus, that particular even scan electrode is regarded as being selected at time t17. Even rows are selected sequentially between times t26 and t19. When an even row is not being selected, its corresponding even scan electrode voltage is driven to Vscan. Also at time t17, there is an addressing operation involving the even sustain electrodes where the even sustain electrodes are driven to a voltage Ve2 near Vs while the odd sustain electrodes are deselected by being driven to the isolation voltage, Viso. If the data electrodes are driven with the X data voltage Vx, an address discharge will occur at each intersecting data electrode and selected row electrode.

The address discharge is initiated by a small discharge between the Xdata electrode and the selected scan electrode. Once initiated, the discharge forms a positive column that spreads over to the associated sustain electrode, and current flows from the sustain electrode to the scan electrode. The magnitude of the current and therefore the strength of the discharge is related to the amount of positive voltage, Ve, on the sustain electrode. Consequently, reducing the voltage on the sustain electrodes from Ve to Ve2 for addressing reduces the discharge current and therefore reduces the strength of the discharge. Since the positive column is capable of bridging the interpixel gap, reducing the discharge strength will reduce the likelihood of the positive column from spanning the interpixel gap and so vertical crosstalk during addressing is reduced. The voltage Ve2 is responsible for the wall charge transfer of the address discharge, and thus provides the ON state wall voltage for the sustain period.

After addressing the desired pixels in each row, the sustain period begins. Each sustain cycle consists of two discharges, first with current flow from scan to sustain side due to a sustain pulse applied to the scan side, second with current flowing from sustain to scan side due to a sustain pulse applied to the sustain side. The first sustain discharge of the first sustain cycle is separated into a discharge of the odd row sub-pixels, followed by a discharge of the even row sub-pixels. While addressing was performed at time t17, with the sustain electrodes at a high voltage and the scan electrodes at a low voltage, the first sustain discharge has the opposite polarity of the address discharge with the sustain electrodes low and the scan electrodes high.

For the time between t20 and t29, scan generator 1805 outputs a voltage Vs2. In an exemplary embodiment of system 1800, sustain voltage Vs is 185V and voltage Vs2 is approximately 135V, i.e., 50V less that sustain voltage Vs. At time t20, odd boost driver 1801 produces boost voltage Vs1. Odd row drivers 1803 pass boost voltage Vs1 through the aforementioned lower output drive transistors to multiplexer 1806, which directs boost voltage Vs1 to the odd rows of PDP 815. Logic circuit 1835 controls even boost driver 1802 to pass through voltage Vs2 from scan generator 1805 to even row drivers 1804, which pass level Vs2 out to the even rows of the PDP 815 through multiplexer 1806.

At time t22, the even and odd sustain electrodes are low, the odd scan electrodes are at boost voltage Vs1, and the odd rows will produce their first sustain discharge between the odd scan electrode and its associated odd sustain electrode. The positive column of the discharge will envelop the odd scan electrode, however it will be less likely to bridge the interpixel gap to a neighboring even scan electrode, since the even scan electrodes are driven with the lower voltage Vs2. For ON sub-pixels, the total cell voltage, is the wall voltage resulting from addressing, Ve2, plus the applied first sustain voltage Vs1. Thus as Ve2 is reduced, Vs1 is increased to provide sufficient voltage to discharge the previously addressed sub-pixels.

At time t28, both boost drivers 1801 and 1802 switch their operating modes so that odd boost driver 1801 passes voltage Vs2 from scan generator 1805, and even boost driver 1802 outputs boost voltage Vs1. At time t29, scan generator 1805 produces voltage 0V, and even boost driver 1802 selects scan generator 1805, thus returning all scan electrodes to 0V. Voltage Vs2 is high enough to prevent a premature second sustain discharge from forming on the odd rows between times t28 and t29 before time t23.

In the first sustain cycle, (1) the odd rows are discharged during time t21, then (2) the even rows are discharged during time t22, and then (3) the odd rows and even rows are simultaneously discharged between times t23 and t24. After the first sustain cycle, for the remainder of the sustain period, both odd rows and even rows are discharged simultaneously. The technique of not applying boost voltage Vs1 to rows adjacent to a discharging site suppresses the positive column from bridging the inter-pixel gap and is conceptually similar to the application of the isolation voltage Viso to the sustain electrodes, as described earlier. By separating and controlling the first sustain discharge, that is, by first discharging the odd rows and then discharging the even rows, or vice versa, vertically adjacent sub-pixel sites are fully discharged and primed so that cross-talk in the second and subsequent sustain discharges is prevented for typical operating levels of sustain voltage Vs, which is less than the boost voltage Vs1. Therefore, vertical crosstalk is less likely to occur during the second and subsequent sustain discharges.

As previously stated, row drivers 1803 and 1804 are controlled by logic circuit 1835 to activate the lower output drive transistors of row drivers 1803 and 1804 during the first sustain cycle, and subsequent sustain cycles. If logic circuit 1835 activates the upper output drive transistors of odd row drivers 1803 applying voltage Vscan, between times t20 and t28 to discharge the odd rows, and then having even row drivers 1804 apply voltage Vscan between the times t28 and t29, then the same waveform of FIG. 18 can be obtained without the need for the odd and even boost drivers 1801 and 1802. Thus, if voltage Vs1 minus Vs2 is equal to Vscan, then boost drivers 1801 and 1802 may be eliminated.

Figure 19A:
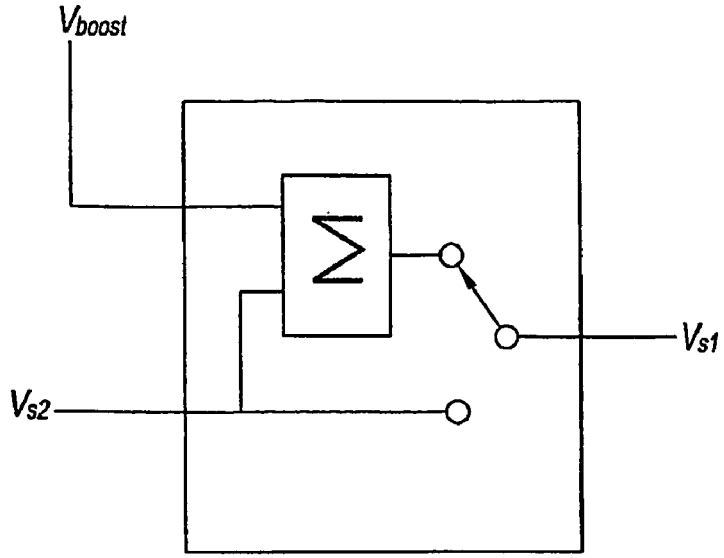
FIGS. 19A and 19B are block diagrams of alternative switching arrangements that may be employed by the boost circuits of the system in FIG. 17.
Figure 19B:
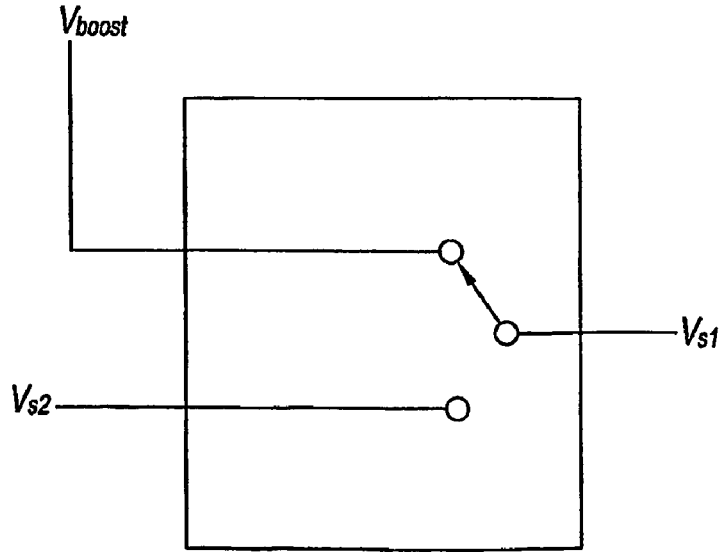

FIGS. 19A and 19B are block diagrams of alternative switching arrangements that may be employed by boost circuits 1801 and 1802 to produce boost voltage Vs1. In the arrangement of FIG. 19A, boost voltage Vs1 is produced by selecting a summation of Vs2 and Vboost, where Vboost is a positive voltage. Thus, Vs1=Vs2+Vboost. In the arrangement of FIG. 19B, Vs1 is produced by selecting Vboost, where Vboost>Vs2. Thus, Vs1=Vboost. Resultantly, for the arrangements in both of FIGS. 19A and 19B, Vs1>Vs2.

It should be understood that the foregoing description is only illustrative of the invention. Various alternatives and modifications can be devised by those skilled in the art without departing from the invention. For instance, this invention is applicable other AC PDP and waveform configurations, where an address discharge extends across a pixel and can spread across an inter-pixel gap, seeking positive charge on an adjacent sustain electrode. The present invention is intended to embrace all such alternatives, modifications and variances that fall within the scope of the appended claims.

What is claimed is:

1. A method for controlling electrodes in a plasma display panel, comprising:

applying a voltage Ve to a sustain electrode during a setting up of said sustain electrode for an addressing operation involving said sustain electrode;

applying a voltage Ve2 to said sustain electrode during said addressing operation, wherein Ve2<Ve, and wherein said sustain electrode is associated with a scan electrode in an electrode pair;

applying a voltage Vs1 to said scan electrode during a first discharging of said electrode pair after said addressing operation;

applying a voltage Vs to said sustain electrode during a second discharging of said electrode pair after said addressing operation, wherein Vs<Vs1; and applying said voltage Vs to said scan electrode during a third discharging of said electrode pair after said addressing operation.

2. The method of claim 1, wherein Ve2<Vs1.

3. The method of claim 1, wherein Ve2=Vs±20%.

4. The method of claim 1, wherein said sustain electrode is a first sustain electrode and adjacent to a second sustain electrode, and wherein said method further comprises:

applying a voltage Viso to said second sustain electrode when applying said voltage Ve2 to said first sustain electrode during said addressing operation, wherein Viso<Ve2.

5. The method of claim 1, wherein said method further comprises applying a negative sloping voltage to said scan electrode during said application of said voltage Ve to said sustain electrode.

6. The method of claim 1, wherein said scan electrode is a first scan electrode, wherein said first scan electrode is adjacent to a second scan electrode, and wherein said method further comprises:

applying a voltage Vs2 to said second scan electrode during a discharging of said electrode pair after said addressing operation, wherein Vs2<Vs1.

7. The method of claim 6, wherein Vs2<Ve2<Vs1.

8. The method of claim 6, wherein said electrode pair is a first electrode pair, wherein said second scan electrode is a part of a second electrode pair, and wherein said method further comprises:

applying said voltage Vs1 to said second scan electrode and said voltage Vs2 to said first scan electrode during a discharging of said second electrode pair.

9. A method for controlling electrodes in a plasma display panel, comprising:

applying a voltage Ve2 to a sustain electrode during an addressing operation involving said sustain electrode, wherein said sustain electrode is associated with a scan electrode in an electrode pair;

applying a voltage Vs1 to said scan electrode during a first discharging of said electrode pair after said addressing operation, wherein Ve2<Vs1;

applying a voltage Vs to said sustain electrode during a second discharging of said electrode pair after said addressing operation, wherein Vs<Vs1; and applying said voltage Vs to said scan electrode during a third discharging of said electrode pair after said addressing operation.

10. The method of claim 9, further comprising:

applying a voltage Ve to said sustain electrode during a setting up of said sustain electrode for said addressing operation, wherein Ve2<Ve.

11. The method of claim 9, further comprising:

applying a voltage Vs to said sustain electrode during a discharging of said electrode pair, wherein Ve2=Vs±20%.

12. The method of claim 9, wherein said sustain electrode is a first sustain electrode and adjacent to a second sustain electrode, and wherein said method further comprises:

applying a voltage Viso to said second sustain electrode when applying said voltage Ve2 to said first sustain electrode during said addressing operation, wherein Viso<Ve2.

13. The method of claim 9, further comprising:

applying a voltage Ve to said sustain electrode during a setting up of said sustain electrode for said addressing operation; and applying a negative sloping voltage to said scan electrode during said application of said voltage Ve to said sustain electrode, wherein Ve2<Ve.

14. The method of claim 9, wherein said scan electrode is a first scan electrode and adjacent to a second scan electrode, and wherein said method further comprises:

applying a voltage Vs2 to said second scan electrode during a discharging of said electrode pair, wherein Vs2<Vs1.

15. The method of claim 14, wherein Vs2<Ve2<Vs1.

16. The method of claim 14, wherein said electrode pair is a first electrode pair, wherein said second scan electrode is a part of a second electrode pair, and wherein said method further comprises:

applying said voltage Vs1 to said second scan electrode and said voltage Vs2 to said first scan electrode during a discharging of said second scan electrode pair.

17. A method for controlling electrodes in a plasma display panel, comprising:

applying a voltage Vs1 to a first scan electrode during a discharging of an electrode pair after an addressing operation involving a sustain electrode, wherein said first scan electrode is associated with said sustain electrode in said electrode pair; and applying a voltage Vs2 to a second scan electrode during said discharging, wherein said second scan electrode is adjacent to said first scan electrode, with no intervening sustain electrode between said first and second scan electrodes, and wherein Vs2<Vs1.

18. The method of claim 17, further comprising:

applying a voltage Ve to said sustain electrode during a setting up for said addressing operation; and applying a voltage Ve2 to said sustain electrode during said addressing operation, wherein Ve2<Ve.

19. The method of claim 17, further comprising:

applying a voltage Ve2 to said sustain electrode during said addressing operation, wherein Vs2<Ve2<Vs1.

20. The method of claim 17, wherein said discharging is a first discharging of said electrode pair after said addressing operation, and wherein said method further comprises:

applying a voltage Vs to said sustain electrode during a second discharging of said electrode pair after said addressing operation, and applying said voltage Vs to said scan electrode during a third discharging of said electrode pair after said addressing operation, wherein Vs<Vs1.

21. The method of claim 17, further comprising:

applying a voltage Ve2 to said sustain electrode during said addressing operation; and applying a voltage Vs to said sustain electrode during said discharging, wherein Ve2=Vs±20%.

22. The method of claim 17, further comprising:

wherein said sustain electrode is a first sustain electrode and adjacent to a second sustain electrode, and wherein said method further comprises:

applying a voltage Ve2 to said first sustain electrode during said addressing operation; and applying a voltage Viso to said second sustain electrode when applying said voltage Ve2 to said first sustain electrode during said addressing operation, wherein Viso<Ve2.

23. The method of claim 17, further comprising:

applying a negative sloping voltage to said first scan electrode during a setting up of said sustain electrode for said addressing operation.

24. The method of claim 17, wherein said electrode pair is a first electrode pair, wherein said second scan electrode is a part of a second electrode pair, and wherein said method further comprises:

applying said voltage Vs1 to said second scan electrode and said voltage Vs2 to said first scan electrode during a discharging of said second electrode pair, after said discharging of said first electrode pair.

25. An apparatus for controlling electrodes in a plasma display panel, comprising:

a circuit that applies a voltage Ve to a sustain electrode during a setting up of said sustain electrode for an addressing operation involving said sustain electrode;

a circuit that applies a voltage Ve2 to said sustain electrode during said addressing operation, wherein Ve2<Ve, and wherein said sustain electrode is associated with a scan electrode in an electrode pair;

a circuit that applies a voltage Vs1 to said scan electrode during a first discharging of said electrode pair after said addressing operation;

a circuit that applies a voltage Vs to said sustain electrode during a second discharging of said electrode pair after said addressing operation, wherein Vs<Vs1; and a circuit that applies said voltage Vs to said scan electrode during a third discharging of said electrode pair after said addressing operation.

26. An apparatus for controlling electrodes in a plasma display panel, comprising:

a circuit that applies a voltage Ve2 to a sustain electrode during an addressing operation involving said sustain electrode, wherein said sustain electrode is associated with a scan electrode in an electrode pair;

a circuit that applies a voltage Vs1 to said scan electrode during a first discharging of said electrode pair after said addressing operation, wherein Ve2<Vs1;

a circuit that applies a voltage Vs to said sustain electrode during a second discharging of said electrode pair after said addressing operation, wherein Vs<Vs1; and a circuit that applies said voltage Vs to said scan electrode during a third discharging of said electrode pair after said addressing operation.

27. An apparatus for controlling electrodes in a plasma display panel, comprising:

a circuit that applies a voltage Vs1 to a first scan electrode during a discharging of an electrode pair after an addressing operation involving a sustain electrode, wherein said first scan electrode is associated with said sustain electrode in said electrode pair; and a circuit that applies a voltage Vs2 to a second scan electrode during said discharging, wherein said second scan electrode is adjacent to said first scan electrode, with no intervening sustain electrode between said first and second scan electrodes, and wherein Vs2<Vs1.

* * * * *